US008182631B2

(12) United States Patent
Sasaki

(10) Patent No.: US 8,182,631 B2
(45) Date of Patent: May 22, 2012

(54) IMAGE-FORMING METHOD BY HEAT-SENSITIVE TRANSFER SYSTEM

(75) Inventor: Yoshiharu Sasaki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 188 days.

(21) Appl. No.: 12/626,400

(22) Filed: Nov. 25, 2009

(65) Prior Publication Data

US 2010/0126656 A1 May 27, 2010

(30) Foreign Application Priority Data

Nov. 27, 2008 (JP) ..... 2008-303248

(51) Int. Cl.
*B44C 1/17* (2006.01)

(52) U.S. Cl. ..... 156/240; 156/230; 156/234; 156/238; 156/277

(58) Field of Classification Search ..... 156/238, 156/277, 234, 240, 230
See application file for complete search history.

(56) References Cited

U.S. PATENT DOCUMENTS 5,571,766 A * 11/1996 Imai et al. ..... 503/227
6,339,443 B1 * 1/2002 Nakanishi et al. ..... 347/200
6,642,948 B2 * 11/2003 Miki ..... 347/213
7,381,685 B2 * 6/2008 Oguma et al. ..... 503/227
2005/0281964 A1 * 12/2005 Yamamoto et al. ..... 428/32.1

FOREIGN PATENT DOCUMENTS

JP 5-8572 A 1/1993
JP 2541796 7/1996
JP 3226167 8/2001
JP 2005-96206 A 4/2005
JP 2006-88691 A 4/2006

* cited by examiner

*Primary Examiner* — Linda L Gray
(74) *Attorney, Agent, or Firm* — Sughrue Mion, PLLC

(57) ABSTRACT

An image-forming method, containing: providing a heat-sensitive transfer image-receiving sheet having at least one heat insulation layer containing hollow polymer particles and at least one receptor layer containing at least one latex polymer, in this order on a support, and a heat-sensitive transfer sheet having a thermal transfer layer containing a thermal transferable dye; feeding the sheets through, between a rotatable platen roller and a thermal head having heating elements aligned in a main scan direction, to move the sheets in a sub scan direction approximately perpendicular to the main scan direction, to form an image on the image-receiving sheet, in which the thermal head has a glaze provided with the heating elements and formed in a convex shape, and the glaze's convex vertex is shifted to an upstream side in the sub scan direction, with respect to the center's position of the heating elements.

10 Claims, 4 Drawing Sheets

IMAGE-FORMING METHOD BY HEAT-SENSITIVE TRANSFER SYSTEM

FIELD OF THE INVENTION

The present invention relates to an image-forming method by a thermal transfer system of forming an image by use of a thermal head. Further, the present invention relates to an image-forming method by the thermal transfer system for providing a printed image of favorable image quality, with preventing occurrence of a relief (an image level difference) on the printed image.

BACKGROUND OF THE INVENTION

In a dye diffusion transfer recording system, a heat-sensitive transfer sheet containing dyes is superposed on a heat-sensitive transfer image-receiving sheet (hereinafter also referred to as an image-receiving sheet), and then the heat-sensitive transfer sheet is heated by a thermal head whose exothermic action is controlled by electric signals, in order to transfer the dyes contained in the heat-sensitive transfer sheet to the image-receiving sheet, thereby recording an image information. Three colors: cyan, magenta, and yellow are used for recording a color image by overlapping one color to other, thereby enabling transferring and recording a color image having continuous gradation for color densities.

In a recording system such a dye diffusion transfer process, it has been known that it is important to impart high heat insulating property to the heat-sensitive transfer image-receiving sheet in order to obtain favorable images.

Thus, for imparting heat insulating property to the heat-sensitive transfer image-receiving sheet, used may be a composite support having a microvoid-containing biaxially oriented polyolefin film as a support for the heat-sensitive transfer image-receiving sheet. However, by this method, because of relaxation of the residual stress at the time of stretching by the heat during printing or coating of a receptor layer, the heat-sensitive transfer image-receiving sheet shrinks, causing crinkling and curling.

Aside from this, proposed was installation of a heat insulation layer containing hollow polymer particles for imparting heat insulating property to the heat-sensitive transfer image-receiving sheet (see, e.g., Japanese Patents No. 2541796 and No. 3226167, JP-A-5-8572 ("JP-A" means unexamined published Japanese patent application) and JP-A-2006-88691). However, such a method is not necessarily satisfactory because the following problems have emerged: it is difficult to obtain a uniform and smooth heat-sensitive transfer image-receiving sheet, there arise improper transfer of images, white spots, surface irregularity and protective-layer adhesion failure, the production process is complicated and disadvantageous from the viewpoint of productivity. Further, such a method brings in a new problem that the glossiness of a solid black image deteriorates.

On the other hand, when a paper support is used as a support of the heat-sensitive transfer image-receiving sheet and a hollow particle layer is provided on the side thereof opposite to the side having a receptor layer, concavity-and-convexity (surface roughness), i.e., relief (image level difference) occurs on the printed image, and thus formation of a high heat-resistance particle layer between the support and the hollow particle layer is proposed (see JP-A-2005-96206). However, the relief occurs also when the image-receiving sheet has a heat-insulating layer containing hollow polymer particles on the receptor layer side, and there is a need for means for solving the problems.

SUMMARY OF THE INVENTION

The present invention resides in an image-forming method, having the steps of:

providing a heat-sensitive transfer sheet having a thermal transfer layer containing a thermal transferable dye;

providing a heat-sensitive transfer image-receiving sheet having at least one heat insulation layer containing hollow polymer particles and at least one receptor layer containing at least one latex polymer, in this order on a support;

superposing the heat-sensitive transfer sheet on the heat-sensitive transfer image-receiving sheet so that the thermal transfer layer of the heat-sensitive transfer sheet and said at least one receptor layer of the heat-sensitive transfer image-receiving sheet are brought into contact with each other;

feeding the heat-sensitive transfer sheet and the heat-sensitive transfer image-receiving sheet through between a thermal head and a rotatable platen roller, while being sandwiched between the thermal head and the rotatable platen roller so that the heat-sensitive transfer sheet is positioned at the thermal head side, with the thermal head having heating elements which supply a heat energy according to an image signal and which are aligned in a main scan direction, thereby to move the heat-sensitive transfer sheet and the heat-sensitive transfer image-receiving sheet in a sub scan direction approximately perpendicular to the main scan direction;

supplying an image data imagewise, to the heating elements of the thermal head; and peeling off the heat-sensitive transfer sheet from the heat-sensitive transfer image-receiving sheet, at a given distance from the heating elements, thereby to form an image on the heat-sensitive transfer image-receiving sheet, wherein the thermal head has a glaze formed in a convex shape, with the glaze being provided with the heating elements, and wherein a position of a convex vertex of the glaze is shifted to an upstream side in the sub scan direction, with respect to a position of the center of the heating elements.

Other and further features and advantages of the invention will appear more fully from the following description, appropriately referring to the accompanying drawings.

DETAILED DESCRIPTION OF THE INVENTION

Figure 1:
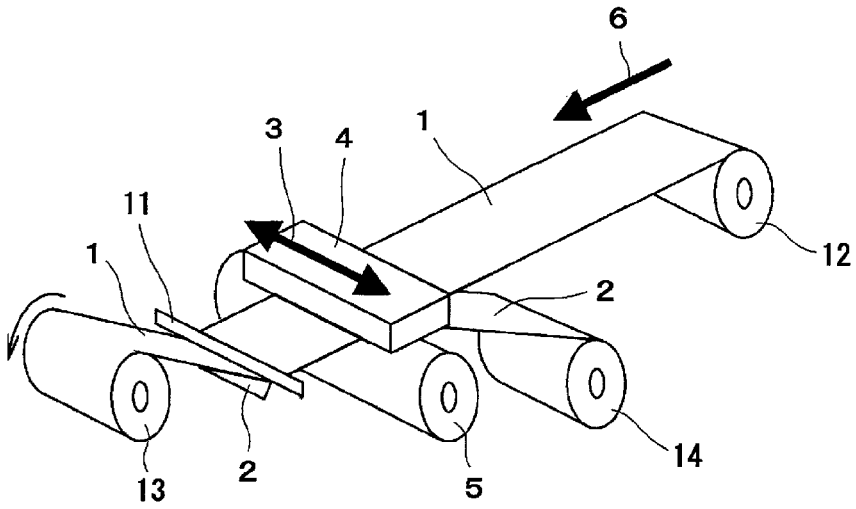
FIG. 1 is an example of a schematic perspective view illustrating the image-forming method according to the present invention.

According to the present invention, there are provided the following means:

(1) An image-forming method, having the steps of:

providing a heat-sensitive transfer sheet having a thermal transfer layer containing a thermal transferable dye;

providing a heat-sensitive transfer image-receiving sheet having at least one heat insulation layer containing hollow polymer particles and at least one receptor layer containing at least one latex polymer, in this order on a support;

superposing the heat-sensitive transfer sheet on the heat-sensitive transfer image-receiving sheet so that the thermal transfer layer of the heat-sensitive transfer sheet and said at least one receptor layer of the heat-sensitive transfer image-receiving sheet are brought into contact with each other;

feeding the heat-sensitive transfer sheet and the heat-sensitive transfer image-receiving sheet through between a thermal head and a rotatable platen roller, while being sandwiched between the thermal head and the rotatable platen roller so that the heat-sensitive transfer sheet is positioned at the thermal head side, with the thermal head having heating elements which supply a heat energy according to an image signal and which are aligned in a main scan direction, thereby to move the heat-sensitive transfer sheet and the heat-sensitive transfer image-receiving sheet in a sub scan direction approximately perpendicular to the main scan direction;

supplying an image data imagewise, to the heating elements of the thermal head; and peeling off the heat-sensitive transfer sheet from the heat-sensitive transfer image-receiving sheet, at a given distance from the heating elements, thereby to form an image on the heat-sensitive transfer image-receiving sheet, wherein the thermal head has a glaze formed in a convex shape, with the glaze being provided with the heating elements, and wherein a position of a convex vertex of the glaze is shifted to an upstream side in the sub scan direction, with respect to a position of the center of the heating elements.

(2) The image-forming method described in the above item (1), wherein the shift is more than 0 and 50 μm or less.

(3) The image-forming method described in the above item (1), wherein the shift is from 5 μm to 50 μm.

(4) The image-forming method described in any one of the above items (1) to (3), wherein the receptor layer contains a polymer compound having at least one aliphatic group substituted with a fluorine atom on its side chain.

(5) The image-forming method described in any one of the above items (1) to (4), wherein a curvature R of the glaze of the thermal head is 3.0 mm or more.

(6) The image-forming method described in any one of the above items (1) to (5), wherein a length of a heating unit formed by the heating elements of the thermal head on the thermal head surface in the sub scan direction, is 150 μm or more.

(7) The image-forming method described in any one of the above items (1) to (6), wherein a head offset of the thermal head is shifted to a downstream side in the sub scan direction.

(8) The image-forming method described in any one of the above items (1) to (7), wherein a line speed is 2 ms/line or higher.

(9) The image-forming method described in any one of the above items (1) to (8), wherein a head pressure is 98.1 N/15.2 cm or less.

(10) The image-forming method described in any one of the above items (1) to (9), wherein a head temperature is 300° C. or higher.

In the present invention, the "main scan direction" means a direction in which the multiple heating elements in the thermal head are aligned.

Further, in the present invention, the "sub scan direction" means a direction in which the heat-sensitive transfer sheet and the heat-sensitive transfer image-receiving sheet move during image formation, which is approximately perpendicular to the main scan direction, on a plane in which the heat-sensitive transfer sheet and the heat-sensitive transfer image-receiving sheet move.

FIG. 1 is an example of a schematic perspective view explaining the image-forming method according to the present invention.

The image-forming method according to the present invention is an image-forming method, having the steps of: providing the heat-sensitive transfer sheet 1 having a thermal transfer layer containing a thermal transferable dye; providing the heat-sensitive transfer image-receiving sheet 2 having at least one heat insulation layer containing hollow polymer particles and at least one receptor layer containing at least one latex polymer, in this order on a support; superposing the heat-sensitive transfer sheet 1 on the heat-sensitive transfer image-receiving sheet 2 so that the thermal transfer layer of the heat-sensitive transfer sheet 1 and said at least one receptor layer of the heat-sensitive transfer image-receiving sheet 2 are brought into contact with each other; feeding the heat-sensitive transfer sheet 1 and the heat-sensitive transfer image-receiving sheet 2 through between the thermal head 4 and the rotatable platen roller 5, while being sandwiched between the thermal head 4 and the rotatable platen roller 5 so that the heat-sensitive transfer sheet 1 is positioned at the thermal head 4 side, with the thermal head 4 having heating elements which supply a heat energy according to an image signal and which are aligned in the main scan direction 3, thereby to move the heat-sensitive transfer sheet 1 and the heat-sensitive transfer image-receiving sheet 2 in the sub scan direction 6 approximately perpendicular to the main scan direction 3; supplying an image data imagewise, to the heating elements of the thermal head 4; and peeling off the heat-sensitive transfer sheet 1 from the heat-sensitive transfer image-receiving sheet 2, at a given distance from the heating elements, thereby to form an image on the heat-sensitive transfer image-receiving sheet 2. In FIG. 1, 11 represents a peeling off member, 12 represents the heat-sensitive transfer sheet at the supplying side; 13 represents the heat-sensitive transfer sheet at the winding side; and 14 represents the heat-sensitive transfer image-receiving sheet at the supplying side.

In the present invention, the thermal head 4 has a glaze formed in the convex shape, with the glaze being provided with the heating elements therein, and the position of the convex vertex of the glaze is shifted toward the upstream side in the sub scan direction, to the position of the center of the heating elements.

The heat-sensitive transfer image-receiving sheet used in the present invention has, on a support, at least one heat insulation layer containing hollow polymer particles, and at least one receptor layer containing at least one latex polymer, in this order.

The latex polymer used in the receptor layer is used to receive a dye. Further, the receptor layer may contain water-soluble polymers, ultraviolet absorbents, release agents, sliding agents, antioxidants, antiseptics, surfactants, and other additives.

Herein, the latex polymer is generally a dispersion of fine particles of thermoplastic resins in a water-soluble dispersion medium. Examples of the thermoplastic resins used for the latex polymer in the present invention include polycarbonates, polyesters, polyacrylates, vinyl chloride-series copolymers, polyurethane, styrene/acrylonitrile copolymers, polycaprolactone and the like.

Among them, polycarbonates, polyesters, and vinyl chloride-series copolymers are preferable, polyesters and vinyl chloride-series copolymers are particularly preferable, vinyl chloride-series copolymers are most preferable.

The polyesters are obtained by condensation of a dicarboxylic acid derivative and a diol compound. The polyesters may contain an aromatic ring and/or a saturated hydrocarbon ring. The polyesters may contain a water-soluble group to promote their dispersion.

The vinyl chloride-series copolymer is a copolymer prepared with vinyl chloride as a polymerization monomer and other monomers, and examples thereof include vinyl chloride-vinyl acetate copolymers, vinyl chloride-acrylate copolymers, vinyl chloride-methacrylate copolymers, vinyl chloride-vinyl acetate-acrylate copolymers, and vinyl chloride-acrylate-ethylene copolymers. As described above, the copolymer may be a binary copolymer or a ternary or higher copolymer, and the monomers may be distributed randomly or uniformly by block copolymerization.

The copolymer may contain a unit derived from an auxiliary monomer component such as vinylalcohol derivatives, maleic acid derivatives, and vinyl ether derivatives. The copolymer preferably contains the vinyl chloride component in an amount of 50 mass % or more, and the unit derived from an auxiliary monomer component such as maleic acid derivative and vinyl ether derivative in an amount of 10 mass % or less.

The latex polymers may be used singly or as a mixture of two or more thereof. The latex polymer may have a uniform structure or a core/shell structure, and in the latter case, the resins constituting the core and the shell, respectively, may have different glass transition temperatures. The glass transition temperature of the latex polymer is preferably 0° C. to 100° C., more preferably 20° C. to 80° C. As described above, the latex polymer is preferably a vinyl chloride-series copolymer, more preferably a copolymer of vinyl chloride and an acrylate or methacrylate, or a copolymer of vinyl chloride and vinyl acetate, and still more preferably a copolymer of vinyl chloride and an alkyl acrylate. Combined use of two or more latex polymers is also preferable. In such a case, combined use of a latex polymer having a glass transition temperature (Tg) of lower than 50° C. and a latex polymer having a glass transition temperature (Tg) of 50° C. or higher is preferable, and more preferably, the latex polymer having a glass transition temperature (Tg) of lower than 50° C. is more preferably contained in an amount as a solid content greater than the latex polymer having a glass transition temperature (Tg) of 50° C. or higher.

Examples of commercially available latex polymers include the followings: acrylate latexes such as Nipol LX814 (Tg: 25° C.) and Nipol LX852X2 (Tg: 43° C.) (trade names, manufactured by Zeon Corporation); polyester latexes such as VYLONAL MD-1100 (Tg: 40° C.), VYLONAL MD-1400 (Tg: 20° C.), VYLONAL MD-1480 (Tg: 20° C.), and VYLONAL MD-1985 (Tg: 20° C.), (trade names, manufactured by Toyobo Co. Ltd.), PLAS COAT Z-850 (Tg: 20° C.) (trade name, manufactured by Goo Chemical Co., Ltd.), and Elitel KZA134 (Tg: 40° C.) (trade name, manufactured by Unitika Ltd.); vinyl chloride latex copolymers such as VINYBLAN 276 (Tg: 33° C.), VINYBLAN 609 (Tg: 46° C.) (trade names, manufactured by Nisshin Chemical Industry Co., Ltd.), Sumielite 1320 (Tg: 40° C.) and Sumielite 1210 (Tg: 30° C.) (trade names, manufactured by Sumika Chemtex Company, Limited).

Examples of commercially available latex polymers having a glass transition temperature (Tg) of 50° C. or higher include the followings: polyester latexes such as, VYLONAL MD-1200 (Tg: 67° C.), VYLONAL MD-1245 (Tg: 61° C.), and VYLONAL MD-1500 (Tg: 77° C.) (trade names, manufactured by Toyobo Co. Ltd.), PLAS COAT Z-450 (Tg: 55° C.) and PLAS COAT Z-561 (Tg: 64° C.) (trade names, manufactured by Goo Chemical Co., Ltd.), and Elitel KA5034 (Tg: 67° C.) (trade name, manufactured by Unitika Ltd.); and vinyl chloride latex copolymers, such as VINYBLAN 900 (Tg: 73° C.) and VINYBLAN 683 (Tg: 72° C.) (trade names, manufactured by Nisshin Chemical Industry Co., Ltd.).

The addition amount of the latex polymer (latex polymer solid content) is preferably 50 to 98 mass %, more preferably 70 to 95 mass %, with respect to all polymers in the receptor layer. The average particle diameter of the latex polymer is preferably 1 to 50,000 nm, more preferably 5 to 1,000 nm.

The receptor layer may contain, as a releasing agent, ordinary solid waxes such as polyethylene or amide wax, silicone oil, a phosphate-series compound, a fluorine-series surfactant, or a silicone-series surfactant.

In the present invention, the receptor layer particularly preferably contains at least one polymer compound having a fluorine atom-substituted aliphatic group on its side chain (hereinafter this compound is also referred to as fluorine-series oligomer), for further improvement of the advantageous effects of the present invention.

The polymer compound having fluorine atom-substituted aliphatic groups on its side chains contained in the receptor layer will be described below in detail.

The polymer compound having fluorine atom-substituted aliphatic groups on its side chains can be derived from a fluoro aliphatic compound (compound having a fluorine atom-substituted aliphatic group(s) on its side chain(s)) produced by a telomerization method (also referred to as a telomer method), or an oligomerization method (also referred to as an oligomer method). The fluorine atom-substituted aliphatic compound can be easily synthesized by, for example, a method described in JP-A-2002-90991.

The fluorine atom-substituted aliphatic group is an aliphatic group (straight-chain, branched or cyclic aliphatic group), preferably an alkyl, alkenyl or cycloalkynyl group having 1 to 36 carbon atoms, having at least one fluorine atom, more preferably an alkyl group having 1 to 36 carbon atoms (preferably 1 to 18 carbon atoms, more preferably 1 to 12 carbon atoms, furthermore preferably 1 to 10 carbon atoms, most preferably 4 to 8 carbon atoms) having at least one fluorine atom. The aliphatic group may be substituted additionally with a substituent other than the fluorine atom. Examples of the substituent include alkyl groups, aryl groups, heterocyclic groups, halogen atoms other than the fluorine atom, a hydroxyl group, alkoxy groups, aryloxy groups, alkylthio groups, arylthio groups, an amino group, alkylamino groups, arylamino groups, heterocyclic amino groups, acylamino groups, sulfone amino groups, carbamoyl groups, sulfamoyl groups, a cyano group, a nitro group, acyl groups, sulfonyl groups, ureido groups, and urethane groups.

In the present invention, the fluorine atom-substituted aliphatic group is most preferably a perfluoroalkyl group.

The polymer compound having a fluorine atom-substituted aliphatic group(s) on its side chain(s) is preferably a polymer or copolymer of a fluorine atom-substituted aliphatic group-containing monomer, and examples of the monomer preferably include acrylic acid derivatives (e.g., acrylic acids, acrylic esters, and acrylamides, preferably acrylic esters and acrylamides, more preferably acrylic esters) and methacrylic acid derivatives (e.g., methacrylic acids, methacrylic esters, and methacrylamides, preferably methacrylic esters and methacrylamides, more preferably methacrylic esters) each having an acyl moiety, alcohol moiety or amide moiety (a substituent bonding with the nitrogen atom) substituted with a fluorine atom-substituted aliphatic group; and acrylonitrile derivatives having a fluorine atom-substituted aliphatic group.

In the case where the polymer compound having fluorine atom-substituted aliphatic groups on its side chains is a copolymer composed of a fluorine atom-substituted aliphatic group-containing monomer, examples of the monomer used in combination include acrylates, methacrylates, acrylonitriles, acrylamides, methacrylamides, olefins, and styrenes. Among these, acrylates, methacrylates, acrylonitriles, acrylamides, and methacrylamides are preferable; acrylates and methacrylates are more preferable; and among them, those having a polyoxyalkylene (e.g., polyoxyethylene, polyoxypropylene) unit in the group substituted on the alcohol moiety or the amide nitrogen atom are preferable.

In the present invention, the polymer above is preferably a copolymer, which may be a binary copolymer or a ternary or higher copolymer.

As the polymers having a fluorine atom-substituted aliphatic group on its side chains, preferred are copolymers of a monomer having an aliphatic group substituted with a fluorine atom and poly(oxyalkylene)acrylate and/or poly(oxyalkylene)methacrylate. They may be random copolymers or block copolymers. Examples of the poly(oxyalkylene) group include poly(oxyethylene) group, poly(oxypropylene) group, and poly(oxybutylene) group. Further, the poly(oxyalkylene) group may be a unit having alkylene groups of chain lengths different from each other in the same chain, such as poly (block connecter of oxyethylene and oxypropylene and oxyethylene) and poly(block connecter of oxyethylene and oxypropylene). Further, the copolymer of a monomer having an aliphatic group substituted with a fluorine atom and poly (oxyalkylene)acrylate (or methacrylate) is not limited to binary copolymers, but may be ternary or more multiple copolymers that can be produced by copolymerizing several different co-monomers such as monomers having two or more different aliphatic groups substituted with a fluorine atom and two or more different kinds of poly(oxyalkylene) acrylate (or methacrylate).

A mass-average molecular weight of the polymer compounds having an aliphatic group substituted with a fluorine atom on its side chains ranges preferably from 5,000 to 50,000, more preferably from 8,000 to 30,000, and further preferably from 10,000 to 20,000.

Examples of the copolymers include copolymers of acrylate (or methacrylate) having a perfluorobutyl group ($—C_4F_9$) and poly(oxyalkylene)acrylate (or methacrylate); copolymers of acrylate (or methacrylate) having a perfluorobutyl group, poly(oxyethylene)acrylate (or methacrylate) and poly (oxypropylene)acrylate (or methacrylate); copolymers of acrylate (or methacrylate) having a perfluorohexyl group ($—C_6F_{13}$) and poly(oxyalkylene)acrylate (or methacrylate); copolymers of acrylate (or methacrylate) having a perfluorohexyl group, poly(oxyethylene)acrylate (or methacrylate) and poly(oxypropylene)acrylate (or methacrylate); copolymers of acrylate (or methacrylate) having a perfluorooctyl group ($—C_8F_{17}$) and poly(oxyalkylene)acrylate (or methacrylate); and copolymers of acrylate (or methacrylate) having a perfluorooctyl group, poly(oxyethylene)acrylate (or methacrylate) and poly(oxypropylene)acrylate (or methacrylate).

Further, the polymer compounds having an aliphatic group substituted with a fluorine atom on its side chain are commercially available as a general name such as "perfluoroalkyl-containing oligomer". For example, the following products can be used.

As the products of Dainippon Ink & Chemicals Incorporated, there are Megafac F-470, Megafac F-471, Megafac F-472SF, Megafac F-474, Megafac F-475, Megafac F-477, Megafac F-478, Megafac F-479, Megafac F-480SF, Megafac F-472, Megafac F-483, Megafac F-484, Megafac F-486, Megafac F-487, Megafac F-489, Megafac F-172D, Megafac F-178K, Megafac F-178RM (each trade name). As the products of Sumitomo 3 M Limited, there are Novec™ FC-4430 and FC-4432 (each trade name).

The polymer compound having aliphatic groups substituted with a fluorine atom on its side chains is preferably a nonionic compound (having no dissociable group in water such as sulfo group and carboxyl group), and more preferably water-soluble to a certain degree. The phrase "water soluble to a certain degree" means that the polymer compound has solubility of 1% or more in pure water at 25° C. Specifically, the polymer is, for example, a polymer compound having a hydroxyl group(s) and/or the oxyalkylene group(s) described above. Preferable examples thereof include water-soluble compounds such as Megafac F-470, Megafac F-472SF, Megafac F-477, Megafac F-479, Megafac F-480SF, Megafac F-484, and Megafac F-486 (all trade names, manufactured by Dainippon Ink & Chemicals Incorporated).

The reason why the polymer compound having an aliphatic group(s) substituted with a fluorine atom on its side chain(s) is preferably nonionic and water soluble to a certain degree is not yet to be understood, but is likely the followings: A nonionic polymer compound having an aliphatic group(s) substituted with a fluorine atom on its side chain(s) has strong affinity for a dye and a receptor polymer after thermal transfer, and the nonionic polymer compound also has moderate affinity for the layer of the heat-sensitive transfer image-receiving sheet prepared by using latex because of its water solubility. Therefore, the nonionic polymer compound bleeds out onto the interface between the heat-sensitive transfer sheet and the heat-sensitive transfer image-receiving sheet during printing under high-temperature and high-humidity condition, exhibiting its effective releasing action.

The addition amount of the polymer compound having aliphatic groups substituted with a fluorine atom on its side chains is 0.2% to 10%, preferably 0.5% to 8% and more preferably 1% to 5%, with respect to the total solid content (mass) in the receptor layer. Although use of only one kind of polymer compound having aliphatic groups substituted with a fluorine atom on its side chains is effective, use of two or more kinds of the polymer compounds above is more effective.

In the present invention, the heat insulating layer contains hollow polymer particles.

The hollow polymer particles in the present invention are polymer particles having independent pores inside of the particles. The hollow polymer particles are preferably aqueous dispersion containing hollow polymer particles. Examples of the hollow polymer particles include non-foaming type hollow particles obtained in the following manner: a dispersion medium, such as water, is contained inside of a capsule wall formed of a polystyrene, acrylic resin, or styrene/acrylic resin, and, after a coating liquid is applied and dried, the dispersion medium in the particles is vaporized out of the particles, with the result that the inside of each particle forms a hollow. Specific examples of the above include Rohpake 1055, manufactured by Rohm and Haas Co.; Boncoat PP-1000, manufactured by Dainippon Ink and Chemicals, Incorporated; SX866(B), manufactured by JSR Corporation; and Nippol MH5055, manufactured by Nippon Zeon (all of these product names are trade names). These hollow polymer particles may be used as a mixture of two or more if necessary. The hollow polymer particle is preferably used as a hollow latex polymer.

The average particle diameter (particle size) of the hollow polymer particles is preferably 0.1 to 5.0 μm, more preferably 0.2 to 3.0 μm, and particularly preferably 0.4 to 2.0 μm. The hollow ratio (percentage of void) of the hollow polymer particles is preferably in the range of from 20% to 70%, and particularly preferably from 30% to 65%.

In the present invention, the particle size of the hollow polymer particle is calculated after measurement of the circle-equivalent diameter of the periphery of particle under a transmission electron microscope. The average particle diameter is determined by measuring the circle-equivalent diameter of the periphery of at least 300 hollow polymer particles observed under the transmission electron microscope and obtaining the average thereof. The hollow ratio of the hollow polymer particles is calculated by the ratio of the volume of voids to the volume of a particle.

The heat insulation layer containing hollow polymer particles may contain a latex polymer as a binder in addition to the hollow polymer particles. The same latex polymer described in the section of the receptor layer is used preferably in the present invention which demands aqueous coating. These latexes may be used singly or in combination of two or more. The thickness of the heat insulation layer containing the hollow polymer particles is preferably from 5 to 50 μm, and more preferably from 5 to 40 μm.

In the present invention, it is preferred that the heat insulation layer containing hollow polymer particles contains hollow polymer particles with a solid content of 50% by mass or more after drying, with more preferable solid content of 60% by mass or more. The upper limit of the solid content is preferably 95% by mass or less.

In the heat-sensitive transfer image-receiving sheet used in the present invention, it is one of preferred embodiments of the present invention that the receptor layer and/or heat insulation layer contains a water-soluble polymer. Herein, "water-soluble polymer" means a polymer which dissolves, in 100 g water at 20° C., in an amount of preferably 0.05 g or more, more preferably 0.1 g or more, and still more preferably 0.5 g or more.

In the present invention, specific examples of the water-soluble polymers which can be used in the heat-sensitive transfer image-receiving sheet, include carrageenans, pectins, dextrins, gelatins, caseins, carboxymethylcelluloses, hydroxyethylcelluloses, hydroxypropylcelluloses, polyvinyl pyrrolidone, polyvinyl pyrrolidone copolymers, polyvinyl alcohol, polyethylene glycol, polypropylene glycol, and water-soluble polyesters. Among these, gelatin and polyvinyl alcohol are preferable, further gelatin is particularly preferable.

Gelatin having a molecular weight of 10,000 to 1,000,000 may be used in the present invention. Gelatin that can be used in the present invention may contain an anion such as $Cl^-$ and $SO_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution.

An ordinary crosslinking agent such as aldehyde-type crosslinking agent, N-methylol-type crosslinking agent, vinylsulfone-type crosslinking agent, or chlorotriazine-type crosslinking agent may be added to the gelatin above. Among the crosslinking agents above, vinylsulfone-type and chlorotriazine-type crosslinking agents are preferable, and typical examples thereof include bisvinylsulfonylmethylether, N,N'-ethylene-bis(vinylsulfonylacetamido)ethane, and 4,6-dichloro-2-hydroxy-1,3,5-triazine or the sodium salt thereof. These crosslinking agents are preferably used in an amount of 0.001 to 1 g, and further preferably 0.005 to 0.5 g, per 1 g (based on solid content) of the water-soluble polymer.

As the polyvinyl alcohol, there can be used various kinds of polyvinyl alcohols such as complete saponification products thereof, partial saponification products thereof, and modified polyvinyl alcohols. With respect to these polyvinyl alcohols, those described in Koichi Nagano, et al., "Poval", Kobunshi Kankokai, Inc. are useful. The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For example, a coated-surface quality can be improved by an addition of boric acid, and the addition of boric acid is preferable. The amount of boric acid to be added is preferably 0.01 to 40 mass %, with respect to the polyvinyl alcohol.

Specific examples of the polyvinyl alcohols include completely saponificated polyvinyl alcohol such as PVA-105, PVA-110, PVA-117 and PVA-117H (trade names, manufactured by KURARAY CO., LTD.); partially saponificated polyvinyl alcohol such as PVA-203, PVA-205, PVA-210 and PVA-220 (trade names, manufactured by KURARAY CO., LTD.); and modified polyvinyl alcohols such as C-118, HL-12E, KL-118 and MP-203 (trade names, manufactured by KURARAY CO., LTD.).

The heat-sensitive (thermal) transfer image-receiving sheet that can be used in the present invention is provided with at least one of the heat insulation layer (porous layer) between the support and the receptor layer. Moreover, an intermediate layer, such as a gloss control layer, a white background adjusting layer, a charge control layer, an adhesive layer, and a primer layer, may be provided on the heat-sensitive transfer image-receiving sheet.

The receptor layer, the heat insulation layer and other intermediate layers are preferably formed by simultaneous multilayer coating, and a multiple number of these layers may be formed as needed. When multiple receptor layers are formed, the layer most separated from the support preferably comprises the two kinds of latex polymers described above.

In addition, to maximize the insulation effect of the heat insulation layer, the receptor layer and the heat insulation layer are preferably in contact with each other without installation of an additional interlayer between the receptor layer and the heat insulation layer.

One or more of a curling control layer, a writing layer, and a charge-control layer may be formed on the backside of the support. Each of these layers may be coated on the backside of the support by using a usual method such as a roll coating, a bar coating, a gravure coating, and a gravure reverse coating.

In the present invention, the heat-sensitive transfer image-receiving sheet preferably has a subbing layer formed between the support and the heat-insulating layer. The subbing layer formed reduces roughness (i.e. concavity and convexity) of the support and provides the support with cushioning property, thus improving adhesiveness of the heat-sensitive transfer image-receiving sheet to the heat-sensitive transfer sheet upon thermal transfer and preventing occurrence of white spots and transfer unevenness of the protective layer upon printing.

In the present invention, the support is not particularly limited, and any support can be used, but it is preferred to use a water-proof support as the support. The use of the waterproof support makes it possible to prevent the support from absorbing moisture, whereby a fluctuation in the performance of the receptor layer with the lapse of time can be prevented. As the waterproof support, for example, coated paper or laminate paper may be used. Especially, a laminated paper is preferred in terms of surface smoothness. It is suitable to use a similar one to a polyethylene laminated paper (this paper is sometimes abbreviated as a WP paper) that is used for a photographic printing paper in the field of silver salt photography, namely a paper composed of cellulose as a main component in which at least one surface of said paper on the same side as the receptor layer-coating side is covered with a polyolefin resin.

The coated paper is a paper obtained by coating a sheet such as base paper with various resins, rubber latexes, or high-molecular materials, on one side or both sides of the sheet, wherein the coating amount differs depending on its use. Examples of such coated paper include art paper, cast coated paper, and Yankee paper.

It is proper to use a thermoplastic resin as the resin to be applied to the surface(s) of the base paper and the like. As such a thermoplastic resin, the following thermoplastic resins (A) to (H) may be exemplified.

(A) Polyolefin resins such as polyethylene resin and polypropylene resin; copolymer resins composed of an olefin such as ethylene or propylene and another vinyl monomer; and acrylic resins.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins such as polymethylmethacrylate, polybutylmethacrylate, polymethylacrylate, polybutylacrylate, or the like; polycarbonate resins, polyvinyl acetate resins, styrene acrylate resins, styrene-methacrylate copolymer resins, vinyltoluene acrylate resins, or the like.

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins such as polyvinyl butyral; and cellulose resins such as ethyl cellulose resin and cellulose acetate resin.

(H) Polycaprolactone resins, styrene/maleic anhydride resins, polyacrylonitrile resins, polyether resins, epoxy resins, and phenolic resins.

The thermoplastic resins may be used either singly or in combination of two or more of those.

The thermoplastic resin may contain a whitener, a conductive agent, a filler, a pigment or dye including, for example, titanium oxide, ultramarine blue, and carbon black; or the like, if necessary.

The laminated paper is a paper which is formed by laminating various kinds of resin, rubber, polymer sheets or films on a sheet such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used singly, or in combination of two or more.

Generally, the polyolefins as the materials useable for the lamination are prepared by using a low-density polyethylene. For improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the laminate, it is preferred to use the blend of a high-density polyethylene and a low-density polyethylene.

The blend of the high-density polyethylene and the low-density polyethylene is, for example, used in a blend ratio (a mass ratio) of 1/9 to 9/1, preferably 2/8 to 8/2, and more preferably 3/7 to 7/3. When the thermoplastic resin layer is formed on the both surfaces of the support, the back side of the support is preferably formed using, for example, the high-density polyethylene or the blend of the high-density polyethylene and the low-density polyethylene. The molecular weight of the polyethylenes is not particularly limited. Preferably, both of the high-density polyethylene and the low-density polyethylene have a melt index of 1.0 to 40 g/10-min and a high extrudability.

The sheet or film may be subjected to a treatment to impart white reflection thereto. As a method of such a treatment, for example, a method of incorporating a pigment such as titanium oxide into the sheet or film can be mentioned. The thus-processed paper is generally used as a support for a photographic printing paper in the field of silver salt photography. This paper is sometimes abbreviated as a WP paper.

The thickness of the support is preferably from 25 μm to 300 μm, more preferably from 50 μm to 260 μm, and further preferably from 75 μm to 220 μm. The support can have any rigidity according to the purpose. When it is used as a support for the heat-sensitive transfer image-receiving sheet of photographic image quality, the rigidity thereof is preferably close to that in a support for use in color silver halide photographic printing paper.

When the support is exposed as it is, there is the case where the heat-sensitive transfer image-receiving sheet is made to curl by moisture and/or temperature in the environment. It is therefore preferable to form a curling control layer on the backside of the support. The curling control layer not only prevents the image-receiving sheet from curling but also has a water-proof function. For the curling control layer, a polyethylene laminate, a polypropylene laminate or the like is used. Specifically, the curling control layer may be formed in a manner similar to those described in, for example, JP-A-61-110135 and JP-A-6-202295.

For the writing layer and the charge controlling layer, an inorganic oxide colloid, an ionic polymer, an antistatic agent or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge controlling layer may be formed in a manner similar to those described in the specification of Japanese Patent No. 3585585.

The plural layers in the present invention are structured using resins as its major components. That is, a coating liquid forming the respective layer is preferably a latex of a polymer. The solid content by mass of the resin put in a latex state in a coating liquid for the respective layer is preferably in a range from 5 to 80% and particularly preferably 20 to 60%. The average particle size of the resin contained in the latex polymer is preferably 5 μm or less and particularly preferably 1 μm or less. The above latex polymer may contain a known additive, such as a surfactant, a dispersant, and a binder resin, according to need.

The heat-sensitive transfer sheet used in the present invention will be explained in detail below.

The heat-sensitive transfer sheet for use in the present invention has, on a support, a thermal transfer layer (hereinafter also referred to as a heat-sensitive transfer layer or a dye layer) containing a thermal transferable dye. A preferable mode of the heat-sensitive transfer sheet is that a transfer protective-layer laminate is formed on the same support with the thermal transfer layer, in which the transfer protective-layer laminate is to form a protective layer of a transparent resin by thermal transfer on the thermally transferred image and thereby to cover and protect the image.

In the heat-sensitive transfer sheet for use in the present invention, preferably, thermal transfer layers in individual colors of yellow, magenta and cyan, and an optional thermal transfer layer in black are repeatedly painted onto a single support in area order in such a manner that the colors are divided from each other. An example of the thermal transfer layer is an embodiment wherein thermal transfer layers in individual colors of yellow, magenta and cyan are painted onto a single support along the long axial direction thereof in area order, correspondingly to the area of the recording surface of the above-mentioned heat-sensitive transfer image-receiving sheet, in such a manner that the colors are divided from each other. Another example thereof is an embodiment wherein not only the three layers but also a thermal transfer layer in black. It is preferred to give marks in order to inform the printer about starting point of the individual colors.

The thermal transfer layer preferably contains a sublimation type dye and a binder resin. It is a preferable embodiment of the present invention that the thermal transfer layer may contains waxes, silicone resins, polymer particles, and inorganic particles, in accordance with necessity.

Each dye in the thermal transfer layer is preferably contained in an amount of 20 to 80 mass % of the dye layer, preferably in that of 30 to 70 mass % thereof.

The coating of the thermal transfer layer is performed by an ordinary method such as roll coating, bar coating, gravure coating, or gravure reverse coating. The coating amount of the thermal transfer layer is preferably from 0.1 to 2.0 g/m$^2$, more preferably from 0.2 to 1.2 g/m$^2$ (the amount is a numerical value converted to the solid content in the layer; any coating amount in the following description is a numerical value converted to the solid content unless otherwise specified). The film thickness of the dye layer is preferably from 0.1 to 2.0 μm, more preferably from 0.2 to 1.2 μm.

The dye used in the present invention is not limited, as long as it is able to diffuse by heat and able to be incorporated in a heat-sensitive transfer sheet, and able to transfer by heat from the heat-sensitive transfer sheet to an image-receiving sheet. As the dye used for the heat-sensitive transfer sheet, ordinarily used dyes or known dyes can be effectively used.

The dye layer may have a mono-layered structure or a multi-layered structure. In the case of the multi-layered structure, the individual layers constituting the dye layer may be the same or different in composition.

As the binder, various kinds of binder are known, and these can be used in the present invention. The binder in the present invention is preferably a cellulose-series resin or a polyvinyl acetal-series resin, more preferably a polyvinyl acetal-series resin. In particular, polyvinyl acetoacetal resin or polyvinyl butyral resin is preferably used in the prevent invention. It is also possible to use them singly or as a mixture or a copolymer, and the binder may be crosslinked with any crosslinking agent.

In the present invention, a transferable protective layer laminate is preferably formed in area order onto the heat-sensitive transfer sheet. The term "forming layers in area order" as used in the present specification means forming thermal transfer layers each having a different hue and/or function layers in the longitudinal direction on the support of the heat-sensitive transfer sheet, by applying them separately in order.

Examples include the case in which thermal transfer layers in individual colors of yellow, magenta and cyan are formed in this order in the longitudinal direction on the support.

Further, any arrangement of these thermal transfer layers can be employed, but it is preferred that thermal transfer layers in individual colors of yellow, magenta and cyan be arranged sequentially in this order on the support.

Arrangement of these thermal transfer layers of different hues in the present invention is not limited to the above, and a transfer layer in black or other transfer layer of a hue other than yellow, magenta, and cyan can be employed as required. Further, it is preferred to form a transferable protective layer (a transferable protective layer laminate) as a function layer, after forming these thermal transfer layers in individual colors of yellow, magenta and cyan in the longitudinal direction on the support, as mentioned above. The transferable protective layer laminate is used for forming a protective layer composed of a transparent resin on a thermally transferred image by thermal transfer and thus covering and protecting the image, thereby to improve durability such as scratch resistance, light-fastness, and resistance to weather. This laminate is effective in the case where the transferred dye is insufficient in image durabilities such as light resistance, scratch resistance, and chemical resistance in the state that the dye is naked in the surface of an image-receiving sheet.

The transferable protective layer laminate can be formed by forming, onto a support, a releasing layer, a protective layer and an adhesive layer, in this order (i.e., in the layer-described order) successively from the support side. The protective layer may be formed by plural layers. In the case where the protective layer also has functions of the other layers, the releasing layer and the adhesive layer can be omitted. It is also possible to use a support on which an easy adhesive layer has already been formed.

In the present invention, as a transferable protective layer-forming resin, preferred are resins that are excellent in scratch resistance, chemical resistance, transparency and hardness. Examples of the resin include polyester resins, acrylic resins, polystyrene resins, polyurethane resins, acrylic urethane resins, silicone-modified resins of the above-described resins, ultraviolet-shielding resins, mixtures of these resins, ionizing radiation-curable resins, and ultraviolet-curing resins. Particularly preferred are polyester resins and acrylic resins. The resins may be crosslinked by any crosslinking agent.

The heat-sensitive transfer sheet preferably has a backside layer (e.g. a heat-resistant lubricating layer) on the surface (i.e. a backing surface) of the support opposite to the surface on which the heat transfer layer is provided, i.e., the backside layer is provided on the surface that is brought into contact with the thermal head and others. Also in the case of a protective layer transferring sheet, a backside layer is preferably formed on the surface (i.e. a backing surface) of the support opposite to the surface on which the transfer protective layer is provided, i.e., the backside layer is provided on the surface that is brought into contact with the thermal head and others. The backside layer is prepared by adding a lubricant, a releasing agent, a surfactant, inorganic particles, organic particles, a pigment, or the like, to a binder, and applying the resultant mixture on the backside of the support. In particular, use of a mono- or di-alkyl (preferably a long-chain alkyl group having 10 to 20 carbon atoms) phosphate, talc or a magnesium compound (magnesium oxide or magnesium salt), or a zinc salt of a long chain aliphatic carboxylic acid (a zinc aliphatic carboxylate having a long chain) is preferable (the number of carbons in the a long chain aliphatic carboxylic acid is preferably 10 to 20, and stearic acid is particularly preferable), and combined use thereof is more preferable.

An intermediate layer may be formed between the backside layer (e.g. a heat-resistant lubricating layer) and the support. The backside layer and the intermediate layer preferably contain inorganic fine-particles and a water-soluble resin or an emulsifiable hydrophilic resin.

In the present invention, an image is formed on the heat-sensitive transfer image-receiving sheet, by superposing the heat-sensitive transfer sheet on the heat-sensitive transfer image-receiving sheet so that the thermal transfer layer of the heat-sensitive transfer sheet and the at least one receptor layer of the heat-sensitive transfer image-receiving sheet are brought into contact with each other; feeding the heat-sensitive transfer sheet and the heat-sensitive transfer image-receiving sheet through between a thermal head and a rotatable platen roller, while being sandwiched between the thermal head and the rotatable platen roller so that the heat-sensitive transfer sheet is positioned at the thermal head side, with the thermal head having heating elements which supply a heat energy according to an image signal and which are aligned in the main scan direction, thereby to move the heat-sensitive transfer sheet and the heat-sensitive transfer image-receiving sheet in the sub scan direction approximately perpendicular to the main scan direction; supplying an image data image-wise, to the heating elements of the thermal head; and peeling off the heat-sensitive transfer sheet from the heat-sensitive transfer image-receiving sheet, at a given distance from the heating elements. Further, the thermal head has a glaze formed in a convex shape, with the glaze being provided with the heating elements, and a position of a convex vertex of the glaze is shifted to an upstream side in the sub scan direction, with respect to a position of the center of the heating elements.

Figure 2:
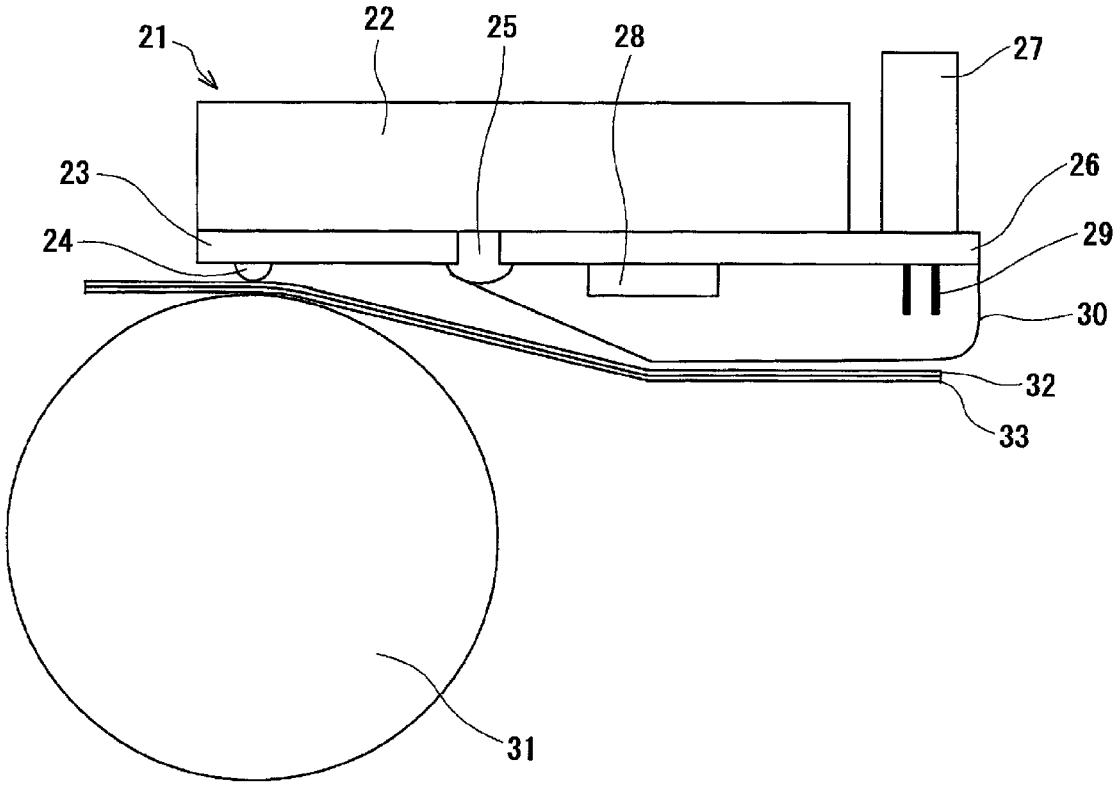
FIG. 2 is a view illustrating an example of the thermal head for heat-sensitive transfer.

FIG. 2 is a schematic side view illustrating an example of the thermal head for use in heat-sensitive transfer, wherein the thermal head 21 is seen in the main scan direction and the region covered with the IC cover 30 is shown to make its internal structure understandable. The thermal head 21 generally has the heat sink 22, an alumina base plate 23 formed on the heat sink 22, and the glaze part 24 having a cross section in the convex shape formed on the alumina base plate 23. Conventionally, the position of the center of the heating elements is generally located on the convex vertex of the glaze part 24.

The heat sink 22, which is made mainly of an aluminum alloy, contains a temperature sensor (not shown in the figure) monitoring a variation in temperature of the alumina base plate 23 caused by the heat generated by heaters therein. In the glaze part 24, the heating elements are formed in the glaze vertex region with a resistor and a pair of electrodes. Conventionally, the position of the center of the heating elements corresponds to the glaze vertex; and generally, an abrasion-resistant layer (protective layer) is formed on the area including the glaze part 24. In addition, the wire 25 and the PCB base plate 26 are formed on the alumina base plate 23 on the heat sink 22, and the PCB base plate 26 is present as it extends on the heat sink 22 and the electric component 27 is present on the extending part. A joint 29 between an IC 28 and the electronic component 27 is present on the surface of the PCB base plate 26 opposite to the surface in contact with the heat sink 22, and the IC 28 and the joint 29 are covered with an IC cover 30, together with the wire 25.

When conducting printing, as shown in FIG. 2, an image is formed (printed) on the heat-sensitive transfer image-receiving sheet 33, by superposing the heat-sensitive transfer sheet 32 on the heat-sensitive transfer image-receiving sheet 33 so that the thermal transfer layer of the heat-sensitive transfer sheet 32 and said at least one receptor layer of the heat-sensitive transfer image-receiving sheet 33 are brought into contact with each other; feeding the heat-sensitive transfer sheet 32 and the heat-sensitive transfer image-receiving sheet 33 through between the rotatable platen roller 31 and the heating elements in the glaze part 24 on the thermal head 21, while being sandwiched between the thermal head 21 and the rotatable platen roller 31 so that the rotatable platen roller 31 is positioned at the side of the heat-sensitive transfer image-receiving sheet 33 and the heating elements are positioned at the side of the heat-sensitive transfer sheet 32, thereby to move the heat-sensitive transfer sheet 32 and the heat-sensitive transfer image-receiving sheet 33 in the sub scan direction.

In the case of a partial-glaze-type thermal head, as shown in FIG. 2, the vertex of the convex shape (convex vertex) and the center of the heating unit (heating elements) shift from each other upon production. The distance difference in position between the glaze convex vertex and the center of the heating elements will be referred to as convex shift.

Figure 3:
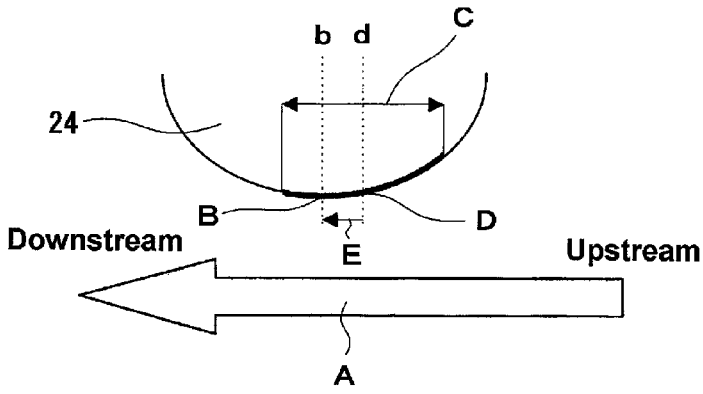
FIG. 3 is a view explaining the convex shift.

FIG. 3 is an explanation view to explain the convex shift, with the schematic cross-sectional view illustrating the unit including the convex vertex of the glaze unit 24, as seen in the sub scan direction. In FIG. 3, the moving direction (sub scan direction) of the superposed composite of the heat-sensitive transfer sheet and the heat-sensitive transfer image-receiving sheet (hereinafter, these superposed two-sheets are also referred to as "recording medium") during printing is indicated by an arrow A, in which the side from which movement begins is indicated by the upstream side and the side to which movement ends is indicated by the downstream side, and FIG. 3 shows a case when the convex vertex B is shifted toward the downstream side. In FIG. 3, the distance E between the line d and the line b is the convex shift. The line d is the line which extends vertically to the moving direction of the recording medium through the position of the center (the center position of the heating elements) D of the length C. The length C is the length of the heating elements on the glaze unit surface in the sub scan direction. The line b is the line which extends vertically to the moving direction of the recording medium through the convex vertex B.

In the present invention, when the glaze convex vertex B is shifted toward the downstream side, with respect to the position of the center D of the heating elements as a reference, the convex shift degree (distance) may be expressed with a plus mark. On the other hand, when the glaze convex vertex B is shifted toward the upstream side, with respect to the position of the center D of the heating elements as a reference, the convex shift degree may be expressed with a minus mark.

In the present invention, the glaze convex vertex B is shifted, with respect to the position of the center D of the heating elements, toward the upstream side (minus side) in the sub scan direction, that is, the convex shift has a minus value.

The recording medium moves with respect to the thermal head, and thus, the peak temperature of the heat-insulating layer in the recording medium is shifted toward the downstream side in the sub scan direction. It is possible to prevent occurrence of a concave portion of the recording medium, by positioning the convex vertex in the upstream side which is the low temperature part of the heat-insulating.

The convex shift of the thermal head is preferably more than 0 and 50 μm or less (0 to −50 μm, but not including 0), more preferably 5 μm or more and 50 μm or less (−5 to −50 μm).

If a convex shift is too large, imaging defects, other than relief, such as deterioration in density and increase in surface roughness is apt to occur.

The convex shift in the thermal head is more preferably −30 to −10 μm. It is possible in this way to improve the state of the relief further and expand the allowance of the image-forming method of the present invention against influences such as deterioration in density and increase in surface roughness.

In the present invention, the glaze part of the thermal head can be prepared in a conventional manner, for example, with reference to JP-A-62-233266 or JPA-2001-105642. A manufacturing process for a glaze part of a normal thermal head is mainly divided into the following five steps of:

(1) applying a glass paste onto an alumina base plate by screen printing method;

(2) sintering the glass paste;

(3) forming a heat resistor layer by patterning;

(4) forming an electrode conductor layer by patterning; and (5) forming a protection film.

Among them, it is favorble in the present invention to use a thermal head, in which the vertex of the glaze part formed in the convex shape is shifted with respect to the position of the center between electrodes, that is prepared by shifting the mask for patterning the electrode conductor layer with respect to the position of the glaze in forming the electrode conductor layer by patterning in the step (4).

Figure 4:
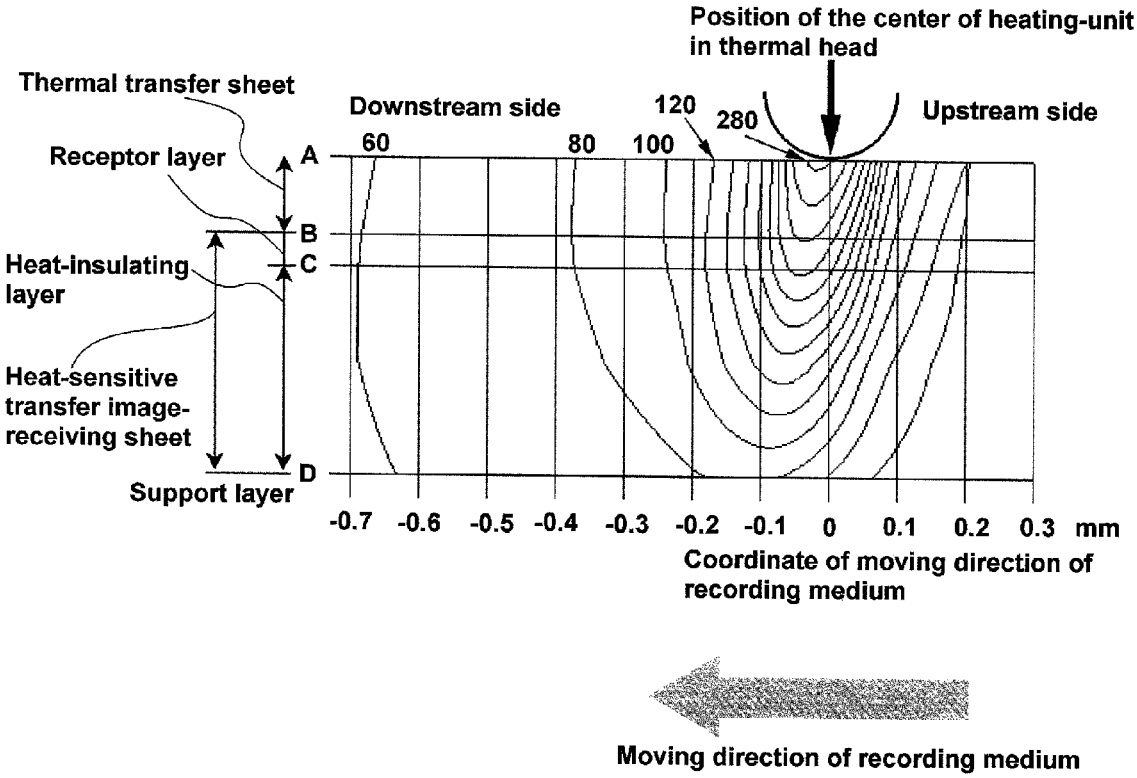
FIG. 4 is a graph showing the position of the thermal-head heating unit and the temperature distribution curve obtained by thermo analytical simulation of the temperature distribution in the recording medium during printing.

FIG. 4 is a graph showing the temperature distribution curve, i.e., the result obtained by thermal analytical simulation of the position of the heating unit of thermal head and the distribution of the temperature in the recording medium during printing. FIG. 4 shows the condition, approximately 0.1 second after initiation of output at the maximum density Dmax, in an almost steady state in the distribution of the temperature in the recording medium.

The ordinate axis represents, in the higher region, the thermal head side (thermal transfer sheet side), and in the lower region, the platen roller side (heat-sensitive transfer image-receiving sheet side), wherein A represents the thermal head/thermal transfer sheet interface (contact surface), B represents the thermal transfer sheet/heat-sensitive transfer image-receiving sheet interface (thermal transfer layer/receptor layer interface), C represents the receptor layer/heat-insulating layer interface, and D represents the heat-insulating layer/support layer interface; and the abscissa represents the position in the moving direction of the recording medium.

Each curve represents a temperature distribution determined at an interval of 20° C., and 60, 80, 100, 120 and 280 indicate 60° C., 80° C., 100° C., 120° C. and 280° C. respectively.

The recording medium moves from the upstream side (right side in FIG. 4) to the downstream side (left side in FIG. 4) at a given velocity. The position of the center of the thermal-head heating unit is located at the coordinate zero in the moving direction of the recording medium. FIG. 4 shows a transmission of the heat energy from the thermal-head heating unit to the recording medium. Although not described in detail here, the calculation for the thermal analytical simulation is made while the state in which the heat energy emitted from the heating unit of the thermal head transmits not only to the recording medium side, as a matter of course, but also through the thermal head member for heat release is taken into consideration. The temperature of the downstream side of the recording medium decreases gradually over time taken for the movement of the recording medium, because of heat release into air and to the support layer side. FIG. 4 shows the result of the behavior of these heat flows.

FIG. 4 shows schematically that the heat in the recording medium supplied thereto from the thermal head moves to the downstream side with movement of the recording medium. It shows that the region having high temperature in the thickness direction of the recording medium is present not at the coordinate zero in the moving direction of the recording medium (immediately under the central heating-unit position of the thermal head) but located in the downstream side thereof.

In the temperature distribution in the recording medium described above, if a thermal head having the same central position of the heating unit and the convex vertex shifted toward downstream side is used, the position of the center pressurized to the recording medium (head pressure) is shifted toward downstream side because of the convex shape. It leads to an application of higher head pressure to the area close to that where the temperature is the highest in the recording medium, and thus, the recording medium is exposed to a high temperature/high pressure condition, resulting in easier deformation, e.g., easier occurrence of relief and image defects.

Because the site of the recording medium where it is easily deformed under high temperature and high pressure is the heat-insulating layer containing hollow polymer particles, for example, the position of the highest temperature in the heat-insulating layer influences deformation of the recording medium.

A glaze curvature R of the thermal head is preferably 3.0 mm or more, more preferably 3.5 mm or more.

Lager thermal-head glaze curvature R leads to smaller pressure per unit area and smaller dent. In contrast, smaller R leads to larger pressure per unit area and thus, larger dent, which in turn leads to worsened relief.

The upper limit of glaze curvature is not particularly limited, but preferably 7.0 mm or less for development of the print at low density.

Figure 7:
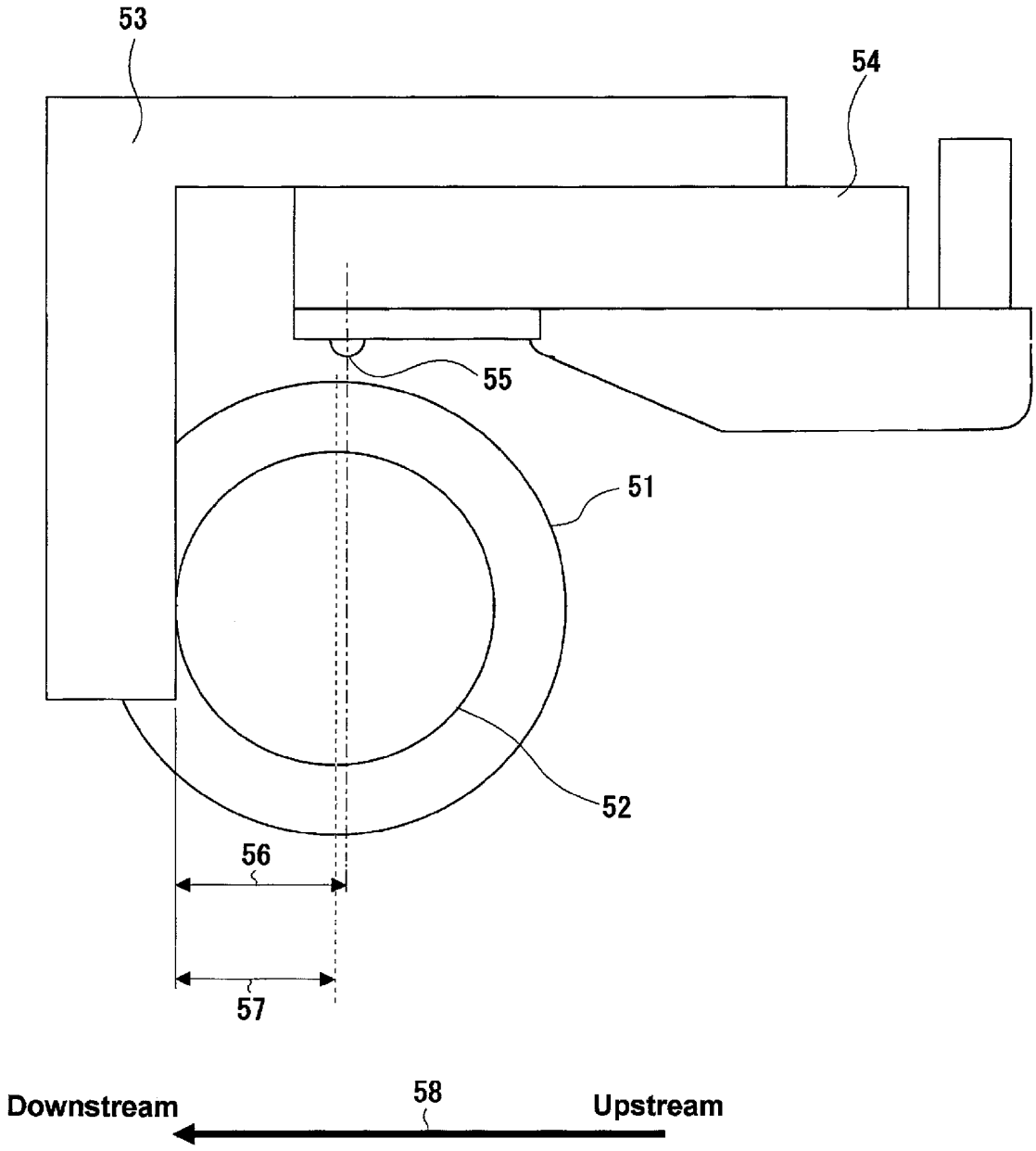
FIG. 7 is a view illustrating the measurement method for head offset.

The head glaze curvature can be determined by measuring the surface profile by using a contact surface-roughness meter (such as SE-2300 type, manufactured by Kosaka Laboratory Ltd.) or a stylus profilometer (such as P-15 type, manufactured by KLA-Tencor Japan), for example with reference to JP-A-2001-277567 (in particular, FIG. 7).

Figure 5:
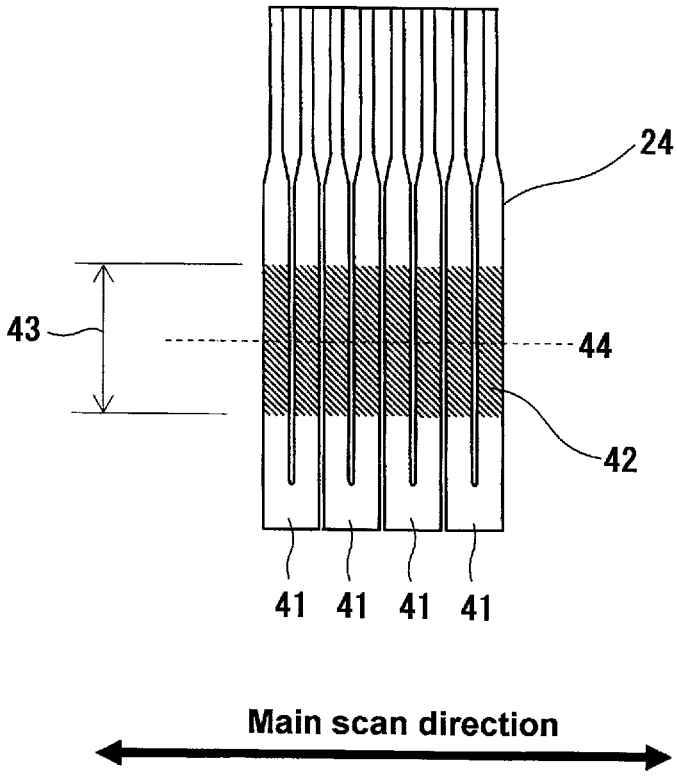
FIG. 5 is an expanded plan view of the region close to the thermal-head glaze part.

A thermal head having a larger length of a heating unit formed by the heating elements of the thermal head on the thermal head surface in the sub scan direction (heating-unit length), if used for supply of the same quantity of heat, becomes relatively lower in temperature, because the contact time to the recording medium is elongated. In other words, a thermal head having a large head heating-unit length preferably gives smaller thermal damage to the recording medium, reduces the dent, and thus, preferably reduces the relief (the image level difference). FIG. 5 is an expanded plan view of the area close to of the glaze part 24 of the thermal head 21, wherein the four the heating elements 41 are aligned in the main scan direction. The area drawn by oblique lines represents the thermal head heating unit 42, and the length 43 between the top and bottom end of the thermal head heating unit 42 represents the head heating unit length. The dotted line 44 is the central line of the thermal head heating unit 42 in the sub scan direction.

The head heating unit length is preferably 150 μm or more, more preferably 170 μm or more.

The upper limit of the head heating unit length is not particularly limited, but 250 μm or less for obtaining resolution of the print.

In the present invention, difference in position in the conveying direction between the center point of the platen roller facing the thermal head and the center point of the thermal head heating unit in the length (sub scan) direction is called head offset. The head offset is preferably located in the downstream side in the sub scan direction.

As for the temperature distribution on the head heating unit in the sub scan direction, the peak temperature is shifted relatively to the downstream side. For that reason, if the head offset is located in the downstream side, the temperature of the recording medium is high for a relatively longer period, giving an image higher in density. Thus, such a printing device having the head offset located in the downstream side is adjusted to lower the output energy and to make the density kept at a particular value, for example, by reduction of voltage. As a result, the peak temperature in the recording medium is relatively lower, leading to decreased thermal damage of the recording medium and consequently to improvement in relief.

The distance between the center point of the platen roller and the center point of the thermal-head heating unit in the length (sub scan) direction is called head offset distance. In the present invention, if the head offset distance is expressed, for example, by "upstream 0.2 mm" or "+0.2 mm", the center line of the thermal-head heater (heating unit) is located in the upstream side by 0.2 mm with respect to the center line of the platen roller in the conveying direction of the recording medium.

On the other hand, if it is expressed by "downstream 0.2 mm" or "−0.2 mm", the center line of the thermal-head heater (heating unit) is located in the downstream side by 0.2 mm with respect to the center line of the platen roller.

The head offset distance is preferably −0.2 mm or more and less than 0 mm, more preferably −0.18 mm or more and less than −0.02 mm.

In the present invention, the temperature of the thermal head surface during image formation is preferably lower for prevention of softening of the recording medium. A heat-insulating layer having a large film thickness and showing large variation in softening by variation in temperature at a particular amount shows large deformation particularly at high temperature of the thermal head surface. On the other hand, a thermal head having too low a surface temperature demands significant reduction of the line speed for obtaining an image at an intended density and is thus, unpractical.

The thermal head surface temperature (head temperature) is preferably 180° C. or lower, more preferably, 150° C. or lower.

In the recent trend of printers, particularly of business printers, there is a demand for high productivity. In other words, an increased number of prints are desirably printed in a particular period of time.

In the present invention, the line speed is preferably 2 ms/line or more, more preferably 1 ms/line or more, and still more preferably 0.7 ms/line or more.

"Line speed" is a relative speed between the recording medium and the thermal head in the sub scan direction during recording, and it is specifically a time required for advancement of a distance of one line (approximately 85 μm, in the case of 300 dpi), normally as expressed by a unit of ms/line.

The line speed is also desirably higher (high speed, lower value) in view of relief.

Higher line speed leads to faster movement of the thermal head and thus, to smaller pressure of the thermal head per time on the recording medium and smaller dent.

Lower line speed leads to slower movement of the thermal head and thus, to increased pressure of the thermal head per time on the recording medium and larger dent.

Mechanistically, the thermal printer used in the image-forming method according to the present invention pressurizes the thermal head to the platen roller fixed, for example, by a spring, or the platen roller to the thermal head fixed, for example, by a spring. These two methods are used commonly. The value, obtained by dividing the relative force applied between the thermal head and the platen roller when a recording medium is held between the thermal head and the platen roller by the contact width in which the thermal head or the platen roller is contact with the recording medium, is called "head pressure".

Specifically, because the heat-sensitive transfer image-receiving sheet is relatively thick at approximately 0.2 mm, the head pressure applied to the recording medium is practically calculated according to the following formula:

[Head pressure (N/cm)]=[Head pressing force (N)]/[Heat-sensitive transfer image-receiving sheet width (cm)]

Generally, it may be referred to as [linear pressure].

In the present invention, the head pressure is preferably 98.1 N (10 kg)/15.2 cm or less, more preferably 78.5 N (8 kg)/15.2 cm or less. Excessively high head pressure leads to increased dent.

The lower limit of the head pressure is not particularly limited, but preferably 58.8 N (6 kg)/15.2 cm or more, for favorable transfer of the dye from the heat-sensitive transfer layer to the receiving layer.

The temperature of the thermal head surface is preferably 180° C. or lower in the present invention, as described above, but significant reduction of the line speed may be required for printing at an intended density. For example, a surface temperature of the thermal head of about 180° C. leads to a line speed of about 7 ms/line, while a surface temperature of the thermal head of about 140° C. to about 10 ms/line for printing at an intended density.

On the other hand, the line speed is preferably higher, and thus, if the sensitivity of the recording medium is the same, the temperature of the thermal head should be raised for printing at an intended density.

The increase in thermal head (surface) temperature is disadvantageous for prevention of relief, as described above.

Because raising the thermal head temperature leads to increase in line speed, if the sensitivity of the recording medium is the same, the head pressure should be raised for printing at an intended density.

It is because it makes the [head pressure] applied to the recording medium per [unit time-unit area] smaller than that during low-speed printing, which easily causes an insufficient heat transfer from the thermal head to the recording medium.

In particular, the pressure is normally smaller in the central region than in both terminal regions in the direction of recording-medium width, and thus, image defects such as deterioration in density and increase in surface roughness are easily occurred in the central region in the width direction during high-speed recording.

Thus, the head pressure should be raised during high speed recording. However, as described above, increase in head pressure is disadvantageous for prevention of relief.

Thus, the convex shift of the thermal head is preferably adjusted to more than 0 and −50 μm or less (0 to −50 μm, but not including 0). Even in the case of a high head temperature, for example of 300° C. or higher and high line speed and head pressure, it is possible to perform high-speed printing, while controlling relief occurrence in an allowable range, at a line speed of 2 ms/line or more (e.g., 0.7 ms/line), by adjusting the head convex shift of the thermal head in the range of more than 0 and −50 μm or less (0 to −50 μM, but not including 0).

It is in this way possible to improve the condition of the relief further and expand the allowance of the image forming method of the present invention against influences such as deterioration in density and increase in surface roughness.

In addition, the energy supplied to the thermal head is preferably lower. Lower recording energy leads to decrease of the temperature of the thermal head surface and thus to prevention of softening of the recording medium. On the other hand, higher recording energy leads to higher temperature of the thermal head surface and thus to easier softening of the recording medium and occurrence of relief.

The recording energy can be defined by the following formula:

[Recording energy (mJ/mm$^2$)]=[Current application period (ms) per line]×[Voltage applied to thermal head (V)]$^2$÷[Thermal head resistance (Ω)]÷[Size of a dot printed (mm$^2$)]

The recording energy is preferably 40 mJ/mm$^2$ or less, more preferably 2 to 25 mJ/mm$^2$.

When an image, a character or the like is recorded, by using a thermal head, if the print resolution is 300 dpi, the size of a pixel is approximately 85 μm (=25400 μm/300 dpi). If the case where sub scan is performed at a line speed of 1 ms/line is considered, the printing speed is 85 μm/ms. In other words, the recording medium and the thermal head travel for a distance of 85 μm in 1 ms. For expression of multiple colors in a pixel, an intended number of drive pulses are normally used during the period of 1 ms. Here, one of the drive pulse is called "gradation pulse".

When the period from initiation of the n$^{th}$ gradation pulse to that of the (n+1)$^{th}$ gradation pulse is defined as gradation pulse cycle (ms), the value represented by the following formula showing the relationship of the gradation pulse cycle with the gradation pulse width (ms): [gradation pulse width (ms)]/[gradation pulse cycle (ms)]×100, is defined as duty ratio (%). In the present invention, the duty ratio is preferably as low as possible.

Normally, the multiple gradation pulse widths (ms) are constant.

Lower duty ratio leads to decrease of the temperature of the thermal head surface, enabling prevention of softening of the recording medium.

Higher duty ratio leads to increase of the temperature of the thermal head surface, easier softening of the recording medium and occurrence of relief.

The duty ratio is preferably less than 90%, more preferably less than 80%.

The lower limit of the duty ratio is not particularly limited, but preferably 60% or more for obtaining a print at an intended maximum density.

The present invention can provide an image-forming method, by a heat-sensitive transfer system, giving a printed image favorable in image quality, without leaving a relief (an image level difference) on the printed image.

The present invention will be described in more detail based on the following examples, but the invention is not intended to be limited thereto. In the following Examples, the terms "part" and "%" are values by mass, unless otherwise specified.

EXAMPLES (Preparation of Heat-Sensitive Transfer Sheet)

A polyester film 6.0 μm in thickness (trade name: Diafoil K200E-6F, manufactured by MITSUBISHI POLYESTER FILM CORPORATION), that was subjected to an easy-adhesion-treatment on one surface of the film, was used as a support. The following back side-layer coating liquid was applied onto the support on the other surface that was not subjected to the easy-adhesion-treatment, so that the coating amount based on the solid content after drying would be 1 g/m$^2$. After drying, the coating liquid was cured by heat at 60° C.

Coating liquids, which will be detailed later, were used to form, onto the easily-adhesive layer coated surface of the thus-formed polyester film, individual heat-sensitive transfer layers in yellow, magenta and cyan, and a transferable protective layer laminate in area order by coating. In this way, a heat-sensitive transfer sheet was produced. The solid coating amount in each of the heat-sensitive transfer layers (dye layers) was set to 0.8 g/m$^2$.

In the formation of the transferable protective layer laminate, a releasing-layer-coating liquid was coated, after drying, a protective-layer-coating liquid was coated thereon, the resultant was dried, and then an adhesive-layer-coating liquid was coated thereon.

| [Back side layer-coating liquid] | |
|---|---|
| Acrylic-series polyol resin (trade name: ACRYDIC A-801, manufactured by Dainippon Ink and Chemicals, Incorporated) | 26.0 mass parts |
| Zinc stearate (trade name: SZ-2000, manufactured by Sakai Chemical Industry Co., Ltd.) | 0.40 mass part |
| Phosphate (trade name: PLYSURF A217, manufactured by Dai-ichi Kogyo Seiyaku Co., Ltd.) | 1.30 mass parts |
| Isocyanate (50% solution) (trade name: BURNOCK D-800, manufactured by Dainippon Ink and Chemicals, Incorporated) | 8.0 mass parts |
| Methyl ethyl ketone/Toluene (2/1, at mass ratio) | 64 mass parts |

| [Yellow-heat-transfer-layer-coating liquid] | |
|---|---|
| Dye compound (Y-1) | 4.0 mass parts |
| Dye compound (Y-2) | 4.0 mass parts |
| Polyvinylacetal resin (trade name: ESLEC KS-1, manufactured by Sekisui Chemical Co., Ltd.) | 6.1 mass parts |
| Polyvinylbutyral resin (trade name: DENKA BUTYRAL #6000-C, manufactured by DENKI KAGAKU KOGYOU K. K.) | 2.1 mass parts |
| Release agent (trade name: X-22-3000T, manufactured by Shin-Etsu Chemical Co., Ltd.) | 0.05 mass part |
| Release agent (trade name: TSF4701, manufactured by MOMENTIVE Performance Materials Japan LLC.) | 0.03 mass part |

-continued

| | |
|---|---|
| Matting agent (trade name: Flo-thene UF, manufactured by Sumitomo Seika Chemicals Co., Ltd.) | 0.12 mass part |
| Methyl ethyl ketone/Toluene (2/1, at mass ratio) | 84 mass parts |

Y-1

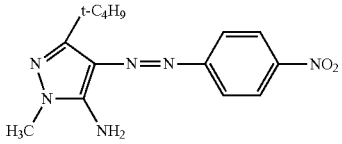

Y-2

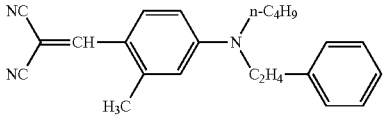

[Magenta-heat-transfer-layer-coating liquid]

| | |
|---|---|
| Dye compound (M-1) | 0.1 mass part |
| Dye compound (M-2) | 0.8 mass part |
| Dye compound (M-3) | 6.5 mass parts |
| Polyvinylacetal resin (trade name: ESLEC KS-1, manufactured by Sekisui Chemical Co., Ltd.) | 8.0 mass parts |
| Polyvinylbutyral resin (trade name: DENKA BUTYRAL #6000-C, manufactured by DENKI KAGAKU KOGYOU K. K.) | 0.2 mass part |
| Release agent (trade name: X-22-3000T, manufactured by Shin-Etsu Chemical Co., Ltd.) | 0.05 mass part |
| Release agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/Toluene (2/1, at mass ratio) | 84 mass parts |

M-1

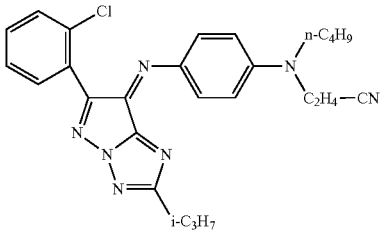

M-2

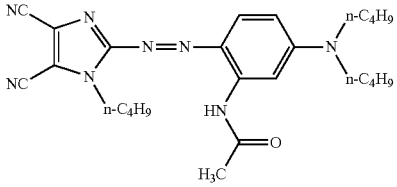

M-3

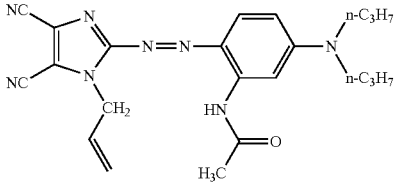

[Cyan-heat-transfer-layer-coating liquid]

| | |
|---|---|
| Dye compound (C-1) | 1.4 mass parts |
| Dye compound (C-2) | 6.6 mass parts |
| Polyvinylacetal resin (trade name: ESLEC KS-1, manufactured by Sekisui Chemical Co., Ltd.) | 7.0 mass parts |
| Polyvinylbutyral resin (trade name: DENKA BUTYRAL #6000-C, manufactured by DENKI KAGAKU KOGYOU K. K.) | 0.8 mass parts |
| Release agent (trade name: X-22-3000T, manufactured by Shin-Etsu Chemical Co., Ltd.) | 0.05 mass part |
| Release agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/Toluene (2/1, at mass ratio) | 84 mass parts |

C-1

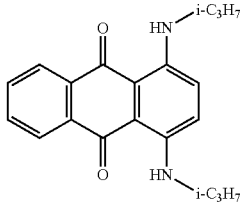

C-2

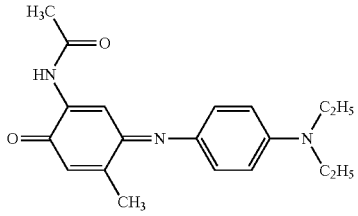

(Transfer Protective Layer Laminate)

On the polyester film coated with the dye layers as described above, coating liquids for a releasing layer, a protective layer and an adhesive layer each having the following composition was coated, to form a transfer protective layer laminate. Coating amounts of the releasing layer, the protective layer and the adhesive layer after drying were 0.3 g/m$^2$, 0.5 g/m$^2$ and 2.2 g/m$^2$, respectively.

[Releasing-layer-coating liquid]

| | |
|---|---|
| Modified cellulose resin (trade name: L-30, manufactured by DAICEL CHEMICAL INDUSTRIES, LTD.) | 5.0 mass parts |
| Methyl ethyl ketone | 95.0 mass parts |

[Protective-layer-coating liquid]

| | |
|---|---|
| Acrylic resin (trade name: DIANAL BR-100, manufactured by MITSUBISHI RAYON CO., LTD.) | 32 mass parts |
| Isopropanol | 70 mass parts |

| [Adhesive-layer-coating liquid] | |
|---|---|
| Acrylic resin (trade name: DIANAL BR-77, manufactured by MITSUBISHI RAYON CO., LTD.) | 25 mass parts |
| The following ultraviolet absorber UV-1 | 0.8 mass part |
| The following ultraviolet absorber UV-2 | 2 mass parts |
| The following ultraviolet absorber UV-3 | 1.5 mass parts |
| The following ultraviolet absorber UV-4 | 0.7 mass part |
| Silicone resin fine particles (trade name: TOSPEARL 120, manufactured by MOMENTIVE Performance Materials Japan LLC.) | 0.05 mass part |
| Methyl ethyl ketone/Toluene (2/1, at mass ratio) | 70 mass parts |

(UV-1)

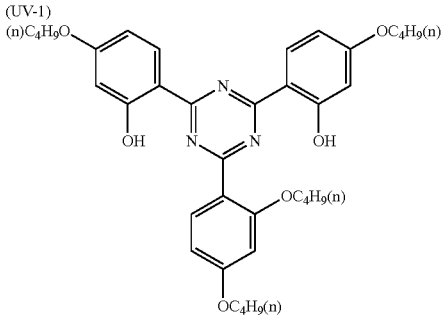

(UV-2)

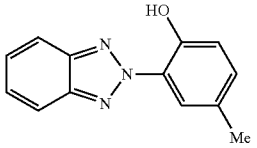

(UV-3)

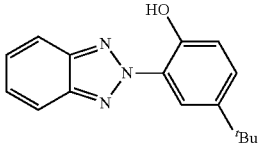

(UV-4)

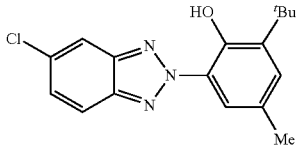

(Preparation of Heat-Sensitive Transfer Image-Receiving Sheet)

A paper support, on both sides of which polyethylene was laminated, was subjected to corona discharge treatment on one surface thereof, and then a gelatin undercoat layer containing sodium dodecylbenzenesulfonate was disposed on the treated surface. The subbing layer, the heat insulation layer, and the receptor layer each having the following composition were multilayer-coated on the gelatin undercoat layer, in the state that the subbing layer, the heat insulation layer, and the receptor layer were laminated in this order from the side of the support, by a method illustrated in FIG. 9 in U.S. Pat. No. 2,761,791. The coating was performed so that coating amounts of the subbing layer, the heat insulation layer, and the receptor layer after drying would be 6.7 g/m$^2$, 8.7 g/m$^2$, and 5.0 g/m$^2$, respectively.

To each layer, 1,2-benzisothiazoline-3-on was added in each amount of 500 ppm with respect to the amount by weight of the each layer-coating liquid. To the subbing layer-coating liquid, a sodium salt of 2,4-dichloro-6-hydroxy-s-triazine was added so as to become a coating amount of 3% with respect to the total coating amount of gelatin as a solid component.

The following compositions are expressed by mass part as a solid content. The % of the vinyl chloride monomer rate is mol %.

| [Receptor layer-coating liquid] | |
|---|---|
| Vinyl chloride-series latex (trade name: VINYBLAN 900, manufactured by Nisshin Chemicals Co., Ltd., (Tg = 70° C.) vinyl chloride unit proportion: 90%) | 31.0 mass parts |
| Vinyl chloride-series latex (trade name: VINYBLAN 609, manufactured by Nisshin Chemicals Co., Ltd., (Tg = 46° C.) vinyl chloride unit proportion: 80%) | 56.0 mass parts |
| Gelatin (10% aqueous solution) | 2.0 mass parts |
| The following ester-series wax EW-1 | 8.0 mass parts |
| Fluorine-based oligomer (trade name: Megafac F-472SF, manufactured by Dainipon Ink and Chemicals, Incorporated) | 2.7 mass parts |
| The following Surfactant F-1 | 0.2 mass part |
| The following Surfactant F-2 | 1.0 mass part |

| [Heat insulation layer-coating liquid] | |
|---|---|
| Hollow latex polymer (trade name: MH5055, manufactured by Nippon Zeon Co., Ltd.) | 65.0 mass parts |
| Gelatin (10% aqueous solution) | 35.0 mass parts |

| [Subbing layer-coating liquid] | |
|---|---|
| Styrene butadiene latex (trade name: SR103, manufactured by NIPPON A & L INC.) | 60 mass parts |
| PVA (6% aqueous solution) (trade name: POVAL PVA 205, manufactured by Kuraray) | 40 mass parts |
| NaOH aqueous solution for adjusting pH to 8 | |

(EW-1)

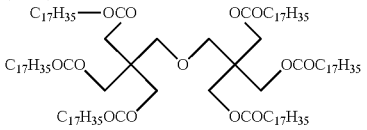

(F-1)

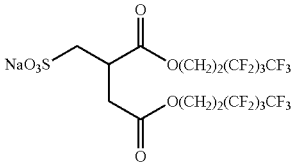

F-2

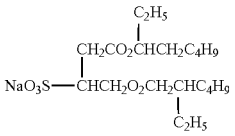

The following methods were used in the tests and evaluations in Examples.

(Evaluation Method of Relief)

The surface concavity and convexity of a black/white pattern having neighboring patterned areas at densities of 0% and 100% was determined by using a color 3D-laser microscope VK-9500 manufactured by KEYENCE CORPORATION in the non-contact mode.

(Visual Evaluation Method by Observation with Naked Eye)

○: An unevenness between the patterned areas at densities of 0% and 100% is distinct or not observable only by intensive visual observation with naked eye.

x: An unevenness having a difference of 2.0 μm or more between the patterned areas at densities of 0% and 100%, which can be detected by visual observation with naked eye.

(Measurement Method of Convex Shift Degree of Thermal Head)

Figure 6:
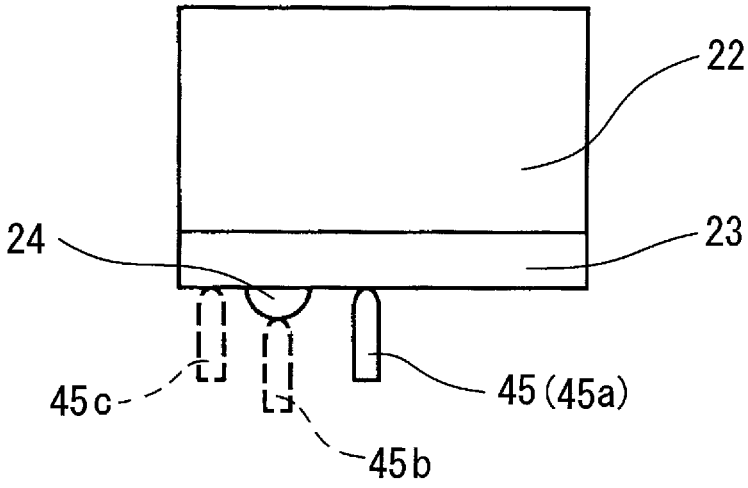
FIG. 6 is a view illustrating the convex shift degree of the thermal head and the method of measuring the head glaze curvature.

The convex shift degree E shown in FIG. 3 was determined by using a contact surface-roughness meter (SE-2300 type manufactured by Kosaka Laboratory Ltd.), as the gauge 45 was moved sequentially via 45*a*, 45*b* and 45*c* in the sub scan direction, as shown in FIG. 6, as it crossed the glaze unit 24 formed on the alumina base plate 23 on the heat sink 22 of thermal head to measure the surface shape of the glaze unit 24. As for the measuring condition, a 90°/4 mN diamond stylus having a diameter of 5 μm was used; the cut-off mode was R+W; the measuring speed was 0.5 mm/sec.; and measurement magnification was 2,000 times vertically and 200 times horizontally.

(Measurement Method of Head Glaze Curvature)

The head glaze curvature was determined by using a contact surface-roughness meter (SE-2300 type manufactured by Kosaka Laboratory Ltd.) under a condition similar to the measurement method for determination of the convex shift degree of the thermal head.

(Measurement Method of Length of Head Heating Unit)

The length 43 shown in FIG. 5 was determined by using a microscope with a function of a ruler.

(Measurement Method of Head Offset)

As shown in the explanatory view of FIG. 7, the measurement member 53 fitted to the metal rotating shaft 52 of the platen roller 51 was attached to the thermal head 54, and the distance 56 between the center point 55 of thermal head heating unit and the measurement member 53 (distance between the solid line and the alternate long and short dash line) was determined under microscope. The distance 56 was compared with the radius of the metal rotating shaft of the platen roller (designed value) 57 (distance between the solid line and the dotted line), and thus, the head offset, i.e., the difference in position between the center point of the platen roller located at a position facing the thermal head and the center point of the thermal head heating unit in the length (sub scan) direction, in the conveying direction was determined. The arrow 58 in FIG. 7 shows the sub scan direction (printing direction from upstream to downstream).

(Measurement Method of Head Surface Temperature)

A thermocouple was fixed to a thermal head heating unit, for example, with an adhesive tape under pressure; an energy allowing output of a black solid image on the recording medium during recording was supplied to the thermal head; and the output from the thermocouple was monitored and recorded with a data logger.

Example 1

An image was formed on the above prepared heat-sensitive transfer image-receiving sheet by using a thermal printer which has a thermal head having heating elements which supply a heat energy according to an image signal and which are aligned in the main scan direction, and a rotatable platen roller; superposing the above prepared heat-sensitive transfer sheet on the heat-sensitive transfer image-receiving sheet so that the thermal transfer layer of the heat-sensitive transfer sheet and the receptor layer of the heat-sensitive transfer image-receiving sheet are brought into contact with each other; feeding the heat-sensitive transfer sheet and the heat-sensitive transfer image-receiving sheet through between the thermal head and the rotatable platen roller, while being sandwiched between the thermal head and the rotatable platen roller so that the heat-sensitive transfer sheet is positioned at the thermal head side, thereby to move the heat-sensitive transfer sheet and the heat-sensitive transfer image-receiving sheet in the sub scan direction approximately perpendicular to the main scan direction; supplying an image data image-wise, to the heating elements of the thermal head; and peeling off the heat-sensitive transfer sheet from the heat-sensitive transfer image-receiving sheet, at a distance of 9 mm from the heating elements. Then, the convex shift of the thermal head was −35 μm; the head glaze curvature radius R was 3.8 mm; the length of the head heating unit was 180 μm; the head offset was downstream 0.1 mm; the head surface temperature was 300° C.; the recording energy was 40 mJ/mm$^2$; the duty ratio was 90%; the line speed was 2 ms/line; and the head pressure was 83.3 N (9 kg)/15.2 cm.

The measured value of the relief (the image level difference) in the obtained image, by the method above, was 1.5 μm, and the result of the visual evaluation of the relief was ○.

Comparative Example 1

An image was formed in the same manner as Example 1, except that the convex shift of the thermal head was set to +25 μm.

The relief of the obtained image was 2 μm or more, and the visual evaluation of the relief was x.

Example 2-1

An image was formed in the same manner as Example 1, except that the head glaze curvature radius R was changed to 3.0 mm. The relief of the obtained image was less than 2 μm, and the visual evaluation of the relief was ○.

Example 2-2

An image was formed in the same manner as Example 1, except that the head glaze curvature radius R was changed to 3.6 mm. The relief of the obtained image was less than 2 μm, and the visual evaluation of the relief was ○.

Comparative Example 2

Comparative Example of the Invention According to Claim 5

An image was formed in the same manner as Example 1, except that the head glaze curvature radius R was changed to 2.0 mm. The relief of the obtained image was 2 μm or more, and the visual evaluation of relief was x.

Example 3-1

An image was formed in the same manner as Example 1, except that the head heating unit length was changed to 160

μm. The relief of the obtained image was less than 2 μm, and the visual evaluation of the relief was ○.

Example 3-2

An image was formed in the same manner as Example 1, except that the head heating unit length was changed to 170 μm. The relief of the obtained image was less than 2 μm, and the visual evaluation of the relief was ○.

Comparative Example 3

Comparative Example of the Invention According to Claim 6

An image was formed in the same manner as Example 1, except that the head heating unit length was changed to 110 μm. The relief of the obtained image was 2 μm or more, and the visual evaluation of the relief was x.

The results in Examples 3-1 and 3-2 and in Comparative Example 3 show that longer head heating unit length gives smaller thermal damage on the recording medium, occurring smaller dents and smaller relief.

Example 4-1

An image was formed in the same manner as Example 1, except that the head offset degree was changed to downstream −0.02 mm. The relief of the obtained image was less than 2 μm, and the visual evaluation of the relief was ○.

Example 4-2

An image was formed in the same manner as Example 1, except that the head offset degree was changed to downstream −0.18 mm. The relief of the obtained image was less than 1.5 μm, and the visual evaluation of the relief was ○.

Comparative Example 4-1

Comparative Example of the Invention According to Claim 7

An image was formed in the same manner as Example 1, except that the head offset degree was changed to upstream +0.05 mm. The relief of the obtained image was 2 μm to less than 3 μm, and the visual evaluation of the relief was x.

Comparative Example 4-2

Comparative Example of the Invention According to Claim 7

An image was formed in the same manner as Example 1, except that the head offset degree was changed to upstream +0.15 mm. The relief of the obtained image was 3 μm to less than 4 μm, and the visual evaluation of the relief was x.

The results in Examples 4-1 and 4-2 and in Comparative Examples 4-1 and 4-2 show that presence of the head offset to the downstream side improves the relief.

Example 5

An image was formed in the same manner as Example 1, except that the head surface temperature was changed to 170° C. The relief of the obtained image was less than 2 μm, and the visual evaluation of the relief was ○.

Example 6

An image was formed in the same manner as Example 1, except that the recording energy provided to the thermal head was changed to 25 mJ/mm$^2$. The relief of the obtained image was less than 2 μm, and the visual evaluation of the relief was ○.

Example 1 for Reference

An image was formed in the same manner as Example 6, except that the recording energy provided to the thermal head was changed to 70 mJ/mm$^2$. The relief of the obtained image was 2 μm or more, and the visual evaluation of the relief was x.

Example 7

An image was formed in the same manner as Example 1, except that the duty ratio was changed to 80%. The relief of the obtained image was less than 2 μm, and the visual evaluation of the relief was ○.

Example 2 for Reference

An image was formed in the same manner as Example 7, except that the duty ratio was changed to 75%. The relief of the obtained image was less than 2 μm, and the visual evaluation of the relief was ○.

Example 8-1

An image was formed in the same manner as Example 1, except that the line speed was changed to 1.5 ms/line. The relief of the obtained image was less than 2 μm, and the visual evaluation of the relief was ○.

Example 8-2

An image was formed in the same manner as Example 8-1, except that the line speed was changed to 1.0 ms/line. The relief of the obtained image was less than 2 μm, and the visual evaluation of the relief was ○.

Example 8-3

An image was formed in the same manner as Example 8-1, except that the line speed was changed to 0.7 ms/line. The relief of the obtained image was less than 2 μm, and the visual evaluation of the relief was ○.

Comparative Example 8-1

Comparative Example of the Invention According to Claim 8

An image was formed in the same manner as Example 8-1, except that the line speed was changed to 5.0 ms/line. The relief of the obtained image was 2 μm or more, and the visual evaluation of the relief was x.

Comparative Example 8-2

Comparative Example of the Invention According to Claim 8

An image was formed in the same manner as Example 8-1, except that the line speed was changed to 10.0 ms/line. The relief of the obtained image was 4 μm or more, and the visual evaluation of the relief was x.

Examples 9-1 to 9-3 Comparative Examples 9-1 to 9-2

Images of Examples 9-1 to 9-3 and Comparative Examples 9-1 and 2 (Comparative Examples according to claim 9 of the present invention) were formed in the same manner as Example 1, except that the parameters were changed to those shown in the following Table 1 by exchanging the spring for head pressurization. The relief of the obtained image was evaluated visually in the same manner as Example 1. The results are shown in Table 1.

TABLE 1

| | Head pressure (N/cm) | Head pressing force (N) (calculated value) | Width of heat-sensitive transfer image-receiving sheet (cm) | Relief (image level difference) (um) | Visual evaluation with naked eye | Head pressing force (kg) |
|---|---|---|---|---|---|---|
| Example 9-1 | 3.9 | 58.8 | 15.2 | less than 2 | ○ | 6 |
| Example 9-2 | 5.2 | 78.5 | 15.2 | less than 2 | ○ | 8 |
| Example 9-3 | 6.5 | 98.1 | 15.2 | less than 2 | ○ | 10 |
| Comparative example 9-1 | 7.7 | 117.7 | 15.2 | 3 or more | x | 12 |
| Comparative example 9-2 | 9.0 | 137.3 | 15.2 | 3.5 or more | x | 14 |

Example 10

An image was formed in the same manner as Example 1, except that the head surface temperature was changed to 400° C., the head pressure was 88.3 N (9.0 kg)/15.2 cm, and the convex shift of the thermal head was changed to −25 μm. The relief of the obtained image was less than 2 μm, and the visual evaluation of the relief was ○. It is possible in this way to improve the condition of the relief and expand the allowance of the image-forming method of the present invention against influences such as deterioration in density and increase in surface roughness.

Comparative Example 10

Comparative Example of the Invention According to Claim 10

An image was formed in the same manner as Example 1, except that the head surface temperature was changed to 400° C., the head pressure was 117.7 N (12 kg)/15.2 cm, and the convex shift of the thermal head was changed to +25 μm. The relief of the obtained image was 2 μm or more, and the visual evaluation of the relief was x.

Having described my invention as related to the present embodiments, it is my intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2008-303248 filed in Japan on Nov. 27, 2008, which is entirely herein incorporated by reference.

What I claim is:

1. An image-forming method, comprising the steps of:

providing a heat-sensitive transfer sheet having a thermal transfer layer containing a thermal transferable dye;

providing a heat-sensitive transfer image-receiving sheet having at least one heat insulation layer containing hollow polymer particles and at least one receptor layer containing at least one latex polymer, in this order on a support;

superposing the heat-sensitive transfer sheet on the heat-sensitive transfer image-receiving sheet so that the thermal transfer layer of the heat-sensitive transfer sheet and said at least one receptor layer of the heat-sensitive transfer image-receiving sheet are brought into contact with each other;

feeding the heat-sensitive transfer sheet and the heat-sensitive transfer image-receiving sheet through between a thermal head and a rotatable platen roller, while being sandwiched between the thermal head and the rotatable platen roller so that the heat-sensitive transfer sheet is positioned at the thermal head side, with the thermal head having heating elements which supply a heat energy according to an image signal and which are aligned in a main scan direction, thereby to move the heat-sensitive transfer sheet and the heat-sensitive transfer image-receiving sheet in a sub scan direction approximately perpendicular to the main scan direction;

supplying an image data to the heating elements of the thermal head; and peeling off the heat-sensitive transfer sheet from the heat-sensitive transfer image-receiving sheet, at a given distance from the heating elements, thereby to form an image on the heat-sensitive transfer image-receiving sheet, wherein the thermal head has a glaze formed in a convex shape, with the glaze being provided with the heating elements, and wherein a position of a convex vertex of the glaze is shifted to an upstream side in the sub scan direction, with respect to a position of the center of the heating elements.

2. The image-forming method according to claim 1, wherein the shift is more than 0 and 50 μm or less.

3. The image-forming method according to claim 1, wherein the shift is from 5 μm to 50 μm.

4. The image-forming method according to claim 1, wherein the receptor layer contains a polymer compound comprising at least one aliphatic group substituted with a fluorine atom on its side chain.

5. The image-forming method according to claim 1, wherein a curvature R of the glaze of the thermal head is 3.0 mm or more.

6. The image-forming method according to claim 1, wherein a length of a heating unit formed by the heating elements of the thermal head on the thermal head surface in the sub scan direction, is 150 μm or more.

7. The image-forming method according to claim 1, wherein a head offset of the thermal head is shifted to a downstream side in the sub scan direction.

8. The image-forming method according to claim 1, wherein a line speed is 2 ms/line or higher.

9. The image-forming method according to claim 1, wherein a head pressure is 98.1 N/15.2 cm or less.

10. The image-forming method according to claim 1, wherein a head temperature is 300° C. or higher.

* * * * *